US008145086B2

(12) United States Patent
Chiyoda et al.

(10) Patent No.: US 8,145,086 B2
(45) Date of Patent: Mar. 27, 2012

(54) IMAGE FORMING APPARATUS

(75) Inventors: Yasuharu Chiyoda, Toride (JP); Yoshikuni Ito, Tokyo (JP); Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 727 days.

(21) Appl. No.: 12/245,236

(22) Filed: Oct. 3, 2008

(65) Prior Publication Data

US 2009/0092409 A1 Apr. 9, 2009

(30) Foreign Application Priority Data

Oct. 9, 2007 (JP) ..... 2007-262839

(51) Int. Cl.
*G03G 15/20* (2006.01)

(52) U.S. Cl. ..... 399/67; 399/33; 399/69
(58) Field of Classification Search ..... 399/33, 399/67
See application file for complete search history.

(56) References Cited

U.S. PATENT DOCUMENTS

| | | | | |
|---|---|---|---|---|
| 7,199,335 | B2 * | 4/2007 | Takami et al. | 219/497 |
| 7,260,351 | B2 | 8/2007 | Nakayama | |
| 7,263,303 | B2 | 8/2007 | Nakayama | |
| 7,283,759 | B2 | 10/2007 | Takahashi et al. | |
| 7,343,130 | B2 | 3/2008 | Nakayama | |
| 7,379,697 | B2 | 5/2008 | Ito et al. | |
| 7,430,392 | B2 | 9/2008 | Ito et al. | |
| 7,460,821 | B2 | 12/2008 | Ai et al. | |
| 2006/0245798 | A1 | 11/2006 | Nakayama | |
| 2007/0059009 | A1 | 3/2007 | Nakayama | |
| 2007/0217803 | A1 | 9/2007 | Nakayama | |
| 2007/0269229 | A1 * | 11/2007 | Maeda et al. | 399/33 |

FOREIGN PATENT DOCUMENTS

| | | | |
|---|---|---|---|
| JP | 1995-013461 | * | 7/1995 |
| JP | 2005-316397 | | 11/2005 |

* cited by examiner

*Primary Examiner* — David Gray
*Assistant Examiner* — Roy Y Yi
(74) *Attorney, Agent, or Firm* — Fitzpatrick, Cella, Harper & Scinto

(57) ABSTRACT

An image forming apparatus capable of executing a mode for decelerating a rotation speed of a fixing member and a pressure member between sheets in a continuous print than that during a fixing operation.

8 Claims, 20 Drawing Sheets

When distance is generated between paper sheets while continuous paper sheet passes (operation)

*FIG. 7*

TIME REQUIRED FOR CHANGING MODES

| | REQUIRED TIME |
|---|---|
| CONSTANT SPEED → CHANGE TO 1/4 SPEED | ONE SECOND |
| 1/4 SPEED → CHANGE TO CONSTANT SPEED | ONE SECOND |
| DETACHING MOTION | TWO SECONDS |
| ATTACHING MOTION | TWO SECONDS |

*FIG. 11*

| TEMPERATURE | 90 - 100℃ | - 110℃ | - 120℃ |
|---|---|---|---|
| DIFFERENCE | 10℃ | 20℃ | 30℃ |
| STATIONARY | 21 SECONDS | 70 SECONDS | 141 SECONDS |
| 1/3 SPEED | 15 SECONDS | 40 SECONDS | 77 SECONDS |
| 2/3 SPEED | 10 SECONDS | 26 SECONDS | 50 SECONDS |
| CONSTANT SPEED | 6 SECONDS | 16 SECONDS | 35 SECONDS |

When distance is generated between paper sheets while continuous paper sheet passes (comparison)

When distance is generated between paper sheets while continuous paper sheet passes (operation)

*FIG. 15*

| SENSOR NAME | FUNCTION | CORRESPONDING PORTION | DISTANCE (MM) (TIME) | MINIMUM REQUIRED TIME |
|---|---|---|---|---|
| DETACHABLE DETERMINATION SENSOR (S1) | DETERMINE WHETHER PRESSURE MEMBER IS SEPARATED | FIRST SHEET SENSOR 81 | 1200(6 SECONDS) | 5 SECONDS |
| DECELERATION DETERMINATION SENSOR (S2) | DETERMINE WHETHER FIXING MEMBER CAN DECELERATE | SECOND SHEET SENSOR 82 | 500(2.5SECONDS) | 2 SECONDS |
| TRANSFER TIMING SENSOR (S3) | DETERMINE WHETHER TRANSFER COMMAND FLAG OF PRESSURE MEMBER | FIRST SHEET SENSOR 81 | 1200(6 SECONDS) | 3 SECONDS |
| ACCELERATION TIMING SENSOR (S4) | CONSTANT SPEED ROTATION FLAG OF FIXING MEMBER | SECOND SHEET SENSOR 82 | 500(2.5SECONDS) | 1 SECOND |
| THIRD SHEET SENSOR (S5) | DETECTION OF COMPLETION OF FIXING PROCESSING | THIRD SHEET SENSOR 85 | - | - |

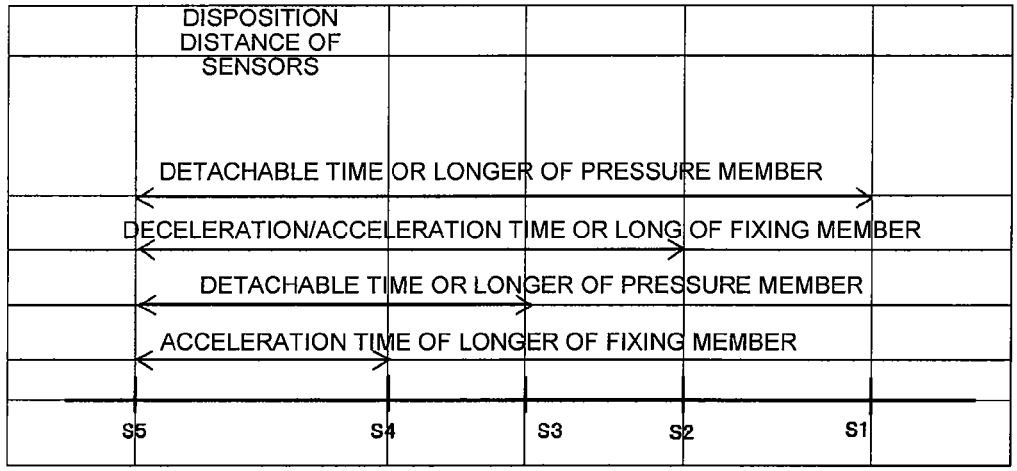

*FIG. 18*

TIME REQUIRED FOR CHANGING MODES

| | REQUIRED TIME | |
|---|---|---|
| CONSTANT SPEED → CHANGE TO 1/3 SPEED | U1 SECOND | 1 SECOND |
| 1/3 SPEED → CHANGE TO CONSTANT SPEED | U2 SECONDS | 1 SECOND |
| SEPARATING MOTION | U3 SECONDS | 2 SECONDS |
| CRIMPING MOTION | U4 SECONDS | 2 SECONDS |

When distance between sheets becomes long
at the time of continuous printing operation

IMAGE FORMING APPARATUS

BACKGROUND OF THE INVENTION

1. Field of the Invention

The present invention relates to an image forming apparatus which forms an image on a recording material.

Especially, the invention relates to an image forming apparatus having a fixing member which heat-fixes a toner image on a recording sheet to a recording sheet by a fixing nip, and a fixing apparatus using a pressure member which comes into contact with the fixing member and forms the fixing nip.

2. Description of the Related Art

In recent years, on-demand print market which prints necessary number of commercial printed materials such as catalogs, posters, brochures and the like, or continuous prints while changing a portion of contents of print such as various debit notes and direct mails is increasing. In the on-demand print market also, an electrophotographic system image forming apparatus is in the limelight in place of offset print which needs plate-making.

Hence, in the electrophotographic system image forming apparatus, such an on-demand print, i.e., a fixing apparatus having a fixing nip which is long in a conveying direction of recording sheets is employed to meet high speed requirement.

However, if the fixing nip is made long, since an amount of heat that a pressure member receives from a fixing member is high, the temperature of the pressure member is prone to rise, and the temperature of the pressure member excessively rises and image failure is generated in some cases. As one example of such image failure which is generated due to excessive temperature rise of the pressure member, there is a phenomenon called "blister". This phenomenon is generated when a coated paper sheet is used as the recording sheet. If the coated paper sheet is excessively heated, moisture in a base layer in the coated paper sheet is evaporated, and this water vapor bursts through a weak portion of the coat layer and is exposed.

Especially, as shown in FIG. 20, if a distance between paper sheets (a distance between a leading recording sheet and a subsequent recording sheet in a conveying direction of the recording sheet, or time elapsed until the subsequent recording sheet enters the fixing nip after the leading recording sheet passes through the fixing nip) becomes long during continuous printing operation, time during which no recording sheet exists in the fixing nip becomes long. As a result, the temperature of the pressure member rises excessively.

Hence, Japanese Patent Application Laid-open No. 2005-316397 prevents the excessive temperature rise by temporarily separating the pressure member from a fixing roller member when a distance between sheets becomes long during the continuous printing operation.

According to the apparatus disclosed in Japanese Patent Application Laid-open No. 2005-316397, however, since the problem is solved by the temporary separation of pressurizing operation, relatively long time is required for separating the pressure member and subsequent re-abutting operation against the fixing member.

That is, in order to suppress the temperature rise of the pressure member when time corresponding to a distance between sheets during the continuous printing operation is relatively short, the problem can not be solved by the temporary separation motion of the pressure member.

This is because that if the problem is to be solved by the temporary separation of the pressure member, time required for separating the pressure member and subsequent re-abutting operation against the fixing member becomes longer than time corresponding to a distance between sheets, and this deteriorates throughput of the image forming operation.

SUMMARY OF THE INVENTION

The present invention provides an image forming apparatus capable of preventing excessive temperature rise of a pressure member while suppressing deterioration of throughput of the image forming operation.

An image forming apparatus of the present invention comprising: an image forming unit for forming a toner image on a recording material; a pair of fixing rotating members which fix a toner image on the recording material to the recording material by a fixing nip; a speed changing unit for changing rotation speeds of the pair of fixing rotating members; and an execution unit which executes a deceleration mode in which the pair of fixing rotating members are controlled to rotate more slowly than in fixing process, while keeping the pair of fixing rotating members in contact with each other until a subsequent recording sheet reaches the fixing nip after a leading recording material passes through the fixing nip when an image is continuously formed on a plurality of recording materials.

Further features of the present invention will become apparent from the following description of exemplary embodiments with reference to the attached drawings.

BRIEF DESCRIPTION OF THE DRAWINGS

FIG. 7 is a table of required time when operation modes are changed;

FIG. 11 shows a result of study of effect of the deceleration mode;

FIG. 15 is a diagram showing layout conditions of sensors;

FIG. 18 is a table of required time when operation modes are changed according to the second embodiment;

DESCRIPTION OF THE EMBODIMENTS

Next, an image forming apparatus according to an embodiment of the present invention will be described with reference to the drawings.

First Embodiment

[Image Forming Apparatus]

Figure 1:
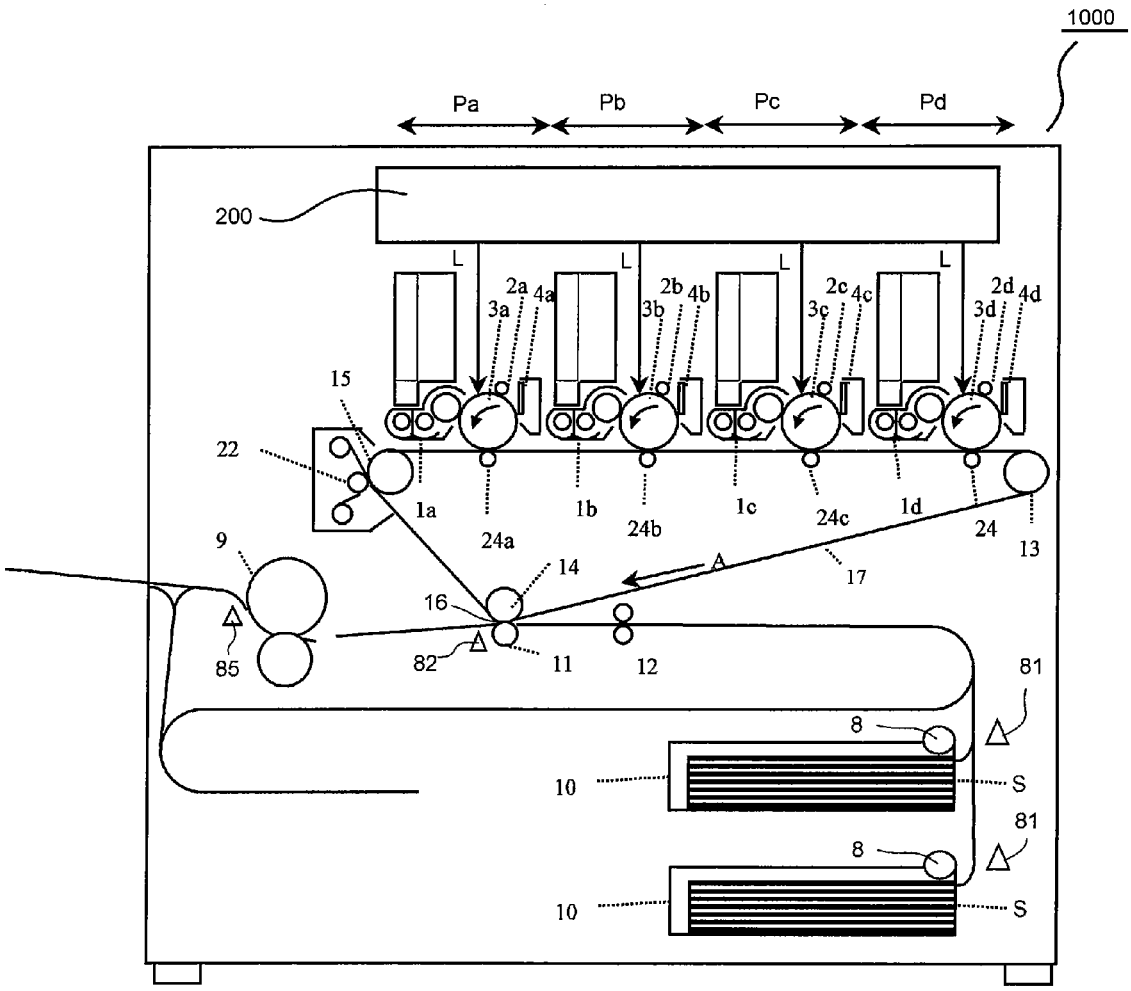
FIG. 1 is a sectional view of an image forming apparatus.

First, the entire structure of the image forming apparatus of the embodiment will be described together with the image forming operation with reference to FIG. 1.

In a main body of the image forming apparatus of the embodiment, first, second, third and fourth image forming portions Pa, Pb, Pc and Pd are provided, and a toner image having different colors is formed through processes such as electrostatic image, developing and transfer. The image forming portions Pa, Pb, Pc and Pd are the same except that the colors of toner are different. Hence, when it is not especially necessary to distinguish, subscripts a, b, c d which are added to the drawings for showing elements provided for colors will be omitted, and they will be described collectively.

The image forming portion P includes electrophotographic photosensitive drums 3 which are special image bearing members in this embodiment, photosensitive members. By developing an electrostatic image formed on each photosensitive drum 3, a toner image of each color is imaged. Intermediate transfer belts 17 which are intermediate transfer members rotatably disposed in adjacent to the respective photosensitive drum 3. The toner image of each color formed on the photosensitive drum 3 is primary transferred onto the intermediate transfer belt 17. Recording sheets S accommodated in a sheet cassette 10 which is a recording material accommodating portion is conveyed toward a secondary transfer portion at predetermined timing, and toner images on the intermediate transfer belts 17 are collectively secondary transferred in the secondary transfer portion. The toner image is fixed to the recording sheet S on which the toner image is transferred by heating and pressurizing the same by a fixing apparatus 9 which is a fixing unit and then, the recording sheet S is discharged out from the apparatus as a recorded image.

The photosensitive drum 3 is provided at its outer periphery with a drum charger 2, a developing device 1, a primary transfer charger 24 and a cleaner 4, and an image exposure apparatus 200 as an exposure unit is provided in an upper portion of the apparatus. Optical systems such as a polygon mirror to be described later and a laser which is a light source are disposed in the image exposure apparatus 200.

Image data which is sent to the image forming apparatus 1000 from a personal computer is once stored in a memory of an image forming processing portion 300. The image forming processing portion 300 converts this image data into a write-signal for forming an electrostatic image.

If an image formation starting signal is sent to the image exposure apparatus 200 from the image forming processing portion 300, a polygon mirror rotates and scans laser light L which is emitted from the light source in accordance with a write-signal, a pencil of light of the scanning light is deflected by a reflection mirror, the pencil of light is collected on a bus of the photosensitive drum 3 by an fθ lens and the photosensitive drum 3 is exposed to light, thereby forming an electrostatic image in accordance with the image signal on the photosensitive drum 3.

A predetermined amount of cyan, magenta, yellow and black toner is charged into supply devices (not shown) as developers in developing devices 1*a*, 1*b*, 1*c* and 1*d*. The developing devices 1 develop the electrostatic images on the photosensitive drum 3 and visualize them as a cyan toner image, a magenta toner image, a yellow toner image and a black toner image.

An intermediate transfer belt 17 comprises an endless belt wound around a drive roller 13, a transfer inner roller 14 and a tension roller 15. The intermediate transfer belt 17 is rotated and driven at the same circumferential velocity as the photosensitive drum 3 in the direction of the arrow A in FIG. 1.

The yellow toner image as a first color formed and carried on the photosensitive drum 3*a* is intermediately transferred on a outer peripheral surface of the intermediate transfer belt 17 by primary transfer bias applied to the intermediate transfer belt 17 during the process of passing through a nip portion between the photosensitive drum 3*a* and the intermediate transfer belt 17. Similarly, a magenta toner image as a second color, a cyan toner image as a third color and a black toner image as a fourth color are superposed and transferred on the intermediate transfer belt 17 sequentially, thereby a synthetic color it is formed.

A secondary transfer roller 11 facing to the intermediate transfer belt 17. The secondary transfer roller 11 is supported in parallel to the intermediate transfer belt 17, and is in contact with a lower surface of the intermediate transfer belt 17. A predetermined secondary transfer bias is applied to the secondary transfer roller 11 by a secondary transfer bias source.

The recording sheets S which are recording materials are separated one-sheet by one-sheet by a supply roller 8 which is a supply unit and supplied from a sheet cassette 10 in synchronization with rotation of the intermediate transfer belt 17 on which a color image is transferred. The supplied recording sheets S are conveyed to a secondary transfer portion 16 which is a nip portion of the intermediate transfer belt 17 and the secondary transfer roller 11 by a pair of rollers such as registration rollers 12 which constitute a conveying unit. A secondary transfer bias is applied to the secondary transfer portion 16 and a toner image on the intermediate transfer belt 17 is transferred to the recording sheet S.

The respective cleaners 4 clean and remove transfer remaining toner from the photosensitive drum 3 in which the primary transfer is completed, and the photosensitive drum 3 is prepared for the next electrostatic image forming operation. A cleaning web (nonwoven fabric) 22 is abutted against a surface of the transfer belt 17 to scrap off toner remaining on the transfer belt 17 and other foreign matters.

In this embodiment, the above-described devices concerning the forming operation of non-fixed toner image to the recording sheet S function as image forming units.

Recording sheets S to which toner images are transferred are introduced into a fixing apparatus 9 sequentially, heat and pressure are added to the recording sheets S, the image is fixed.

[Fixing Apparatus]

Next, the fixing apparatus which is the fixing unit of the embodiment will be described with reference to FIG. 2. A pair of fixing rotating members is disposed in the fixing apparatus 9 of the embodiment. The fixing rotating members six a non-fixed toner image formed on the recording sheet S onto the recording sheets S in a fixing nip N which is a crimp portion.

One of the pair of fixing rotating members is a fixing roller 51 as a fixing member having a heat source, and the other one is a pressure roller 52 as a pressure member (pressure rotating member) which crimps the fixing roller 51 to form the fixing nip N.

The fixing roller 51 of the embodiment is formed such that an elastic layer 51*b* made of silicone rubber having rubber hardness of 20° (JIS-A 1 kg weight) is formed by 2.5 mm on a hollow core metal 51*a* made of Al having outer diameter of ϕ75.0 mm and thickness of 3.0 mm. A PFA tube having a thickness of 10 to 100 μm was coated on a surface thereof and a fixing roller 51 having outer diameter of ϕ80 mm was used. The fixing roller 51 includes a halogen heater 58 therein as a heating source, the temperature of the fixing roller 51 is detected by a main thermistor 90 which is a temperature sensor, a temperature control device drives and controls the halogen heater 58 based on the result and the temperature is adjusted to 180° C.

The pressure roller 52 of the embodiment has an elastic layer 52*b* made of silicone rubber by 2.0 mm. The elastic layer 52*b* has rubber hardness of 20° (JIS-A 1 kg weight). The elastic layer 52*b* is provided around a ϕ75 mm hollow core metal 52*a* made of Al.

A PFA tube having a thickness of 10 to 100 μm was coated on a surface thereof and a pressure roller 52 having an outer diameter of ϕ80 mm was used. The fixing roller 51 is pressurized by the pressure roller 52 under the total pressure of 700 to 1500 N, and the pressure roller 52 can be rotated.

A width (nip width) of contact portion between the fixing roller 51 and the pressure roller 52 of the embodiment is about 10 mm. The pressure roller 52 is provided therein with the halogen heater 58 as the heating source, a sub-thermistor 91 which is a temperature sensor detects the temperature of the pressure roller 52, and a control device drives and controls the halogen heater 58 based on a result thereof and the temperature is adjusted to 140° C.

Figure 2:
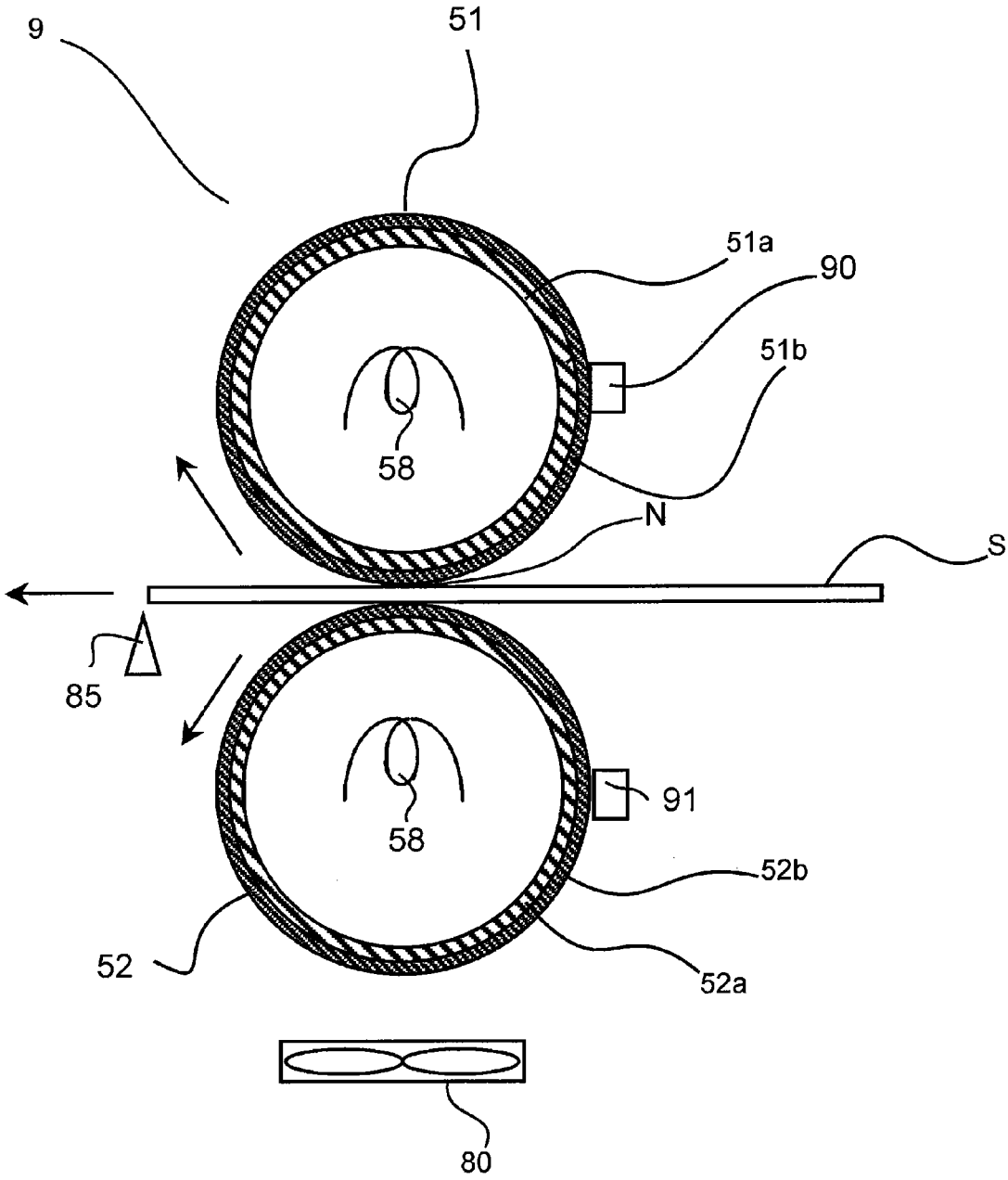
FIG. 2 is a sectional view of a fixing apparatus at the time of a normal fixing operation.
Figure 3:
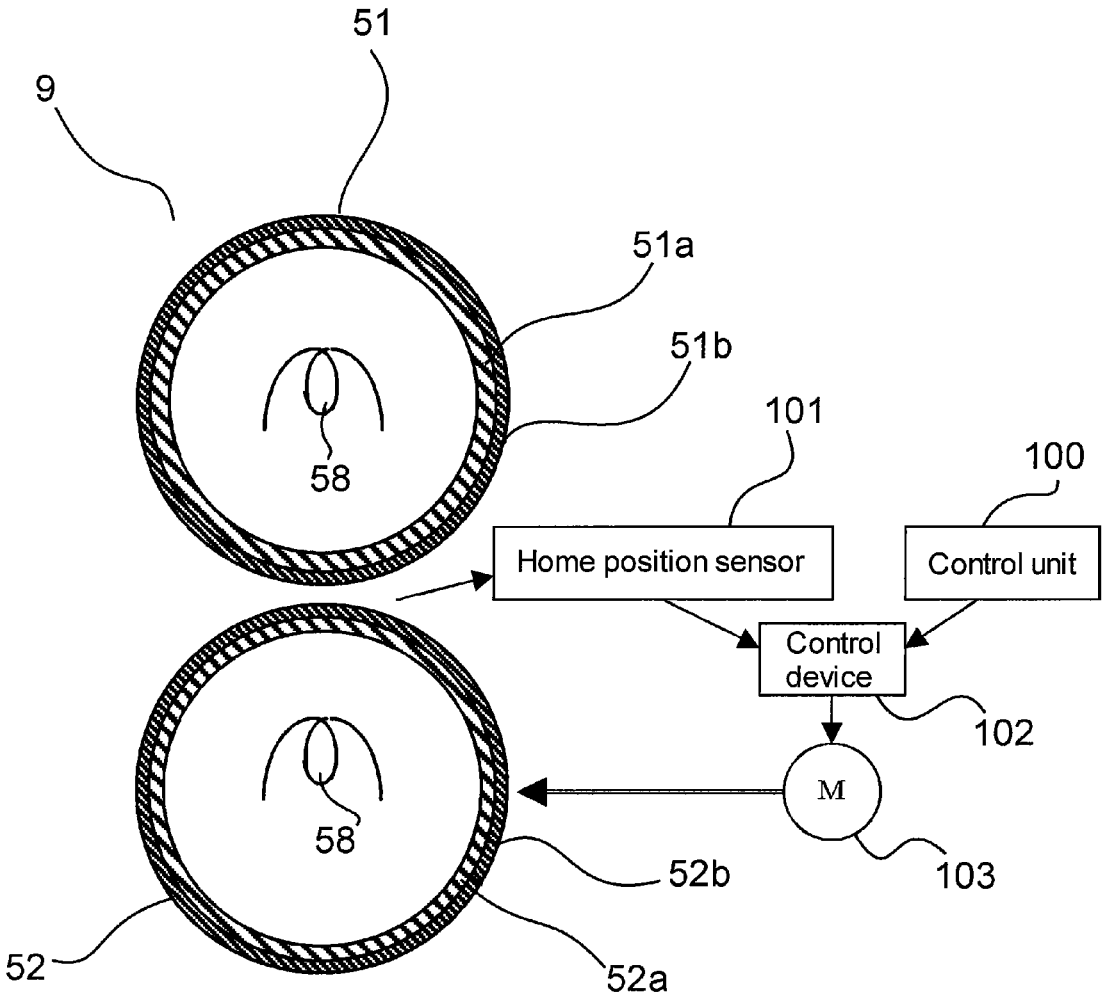
FIG. 3 is a diagram for illustrating a state where a pressure roller is separated from a fixing roller.

The pressure roller 52 is vertically movably constituted as viewed in FIG. 2. The fixing roller 51 and the pressure roller 52 can crimp and separate from each other by a contact/separation mechanism 95 as a contact/separation unit. The contact/separation mechanism 95 includes a home position sensor 101 to be described later and a detaching motor 103. The contact/separation mechanism 95 can move a pressure roller 52 to two position, i.e., a position where the pressure roller 52 crimps the fixing roller 51 to form the fixing nip N, and a position where the pressure roller 52 and the fixing roller 51 are separated from each other as shown in FIG. 3. The contact/separation mechanism 95 includes a home position sensor 101 which detects that the pressure roller 52 is separated from the fixing roller 51. When a command for separating from the pressure roller contact/separation control device 102 is output, the pressure roller 52 is moved by a detaching motor 103 to a position where the home position sensor 101 detects. When a crimp command is output from the pressure roller contact/separation control device 102, the detaching motor 103 moves the pressure roller 52 toward the fixing roller 51 by a constant distance from a position of the separating state as a reference. With this, the pressure roller 52 crimps the fixing roller 51.

With this, in a print state, the fixing roller 51 and the pressure roller 52 crimp each other and the fixing nip N is formed. However, after the fixing operation is completed, they are separated and brought into a standby state. This separating operation prevents compression permanent deformation of rubber, and the durability of the fixing roller 51 and the pressure roller 52 is enhanced.

Cooling fans 80 as cooling units are provided at positions for cooling the pressure roller 52. In this embodiment, four cooling fans 80 are disposed at equal distances from one another in the longitudinal direction of the pressure roller 52, and their operations are controlled by a fan control device.

[Control Unit]

The main thermistor 90 and the sub-thermistor 91 abut against central portions of the fixing roller 51 and the pressure roller 52 in the longitudinally widthwise direction, and are connected to a temperature control device. The temperature control device controls the operation of the halogen heater 58 such that the temperature detected by the thermistors becomes equal to a target temperature. The operations of the fan control devices which control the temperature control device and cooling fan 80 are controlled by a control unit which is a central control device.

If a temperature detected by the main thermistor 90 exceeds 200° C. during fixing operation when a recording sheet S passes through a fixing nip N which is formed by the fixing roller 51 and the pressure roller 52, there is a possibility that an image failure occurs when toner on the recording sheet S is high temperature offset or the recording sheet S is deformed. This fact is confirmed by a plurality of times of tests. Even if a temperature detected by the sub-thermistor 91 exceeds 130° C., an image failure or a separation failure may be caused by deformation of a recording sheet S similarly.

On the other hand, even if a temperature detected by the main thermistor 90 becomes 160° C. or lower, toner on a recording sheet S is not sufficiently melted and low temperature offset occurs.

Therefore, when temperatures detected by the main thermistor 90 and the sub-thermistor 91 are deviated from a constant range, it is necessary to once stop a print job, and to return the temperatures to normal values by the halogen heater 58 and the cooling fan 80.

If the halogen heater 58 normally adjusts the temperature, the temperature of the fixing roller 51 is transmitted to the pressure roller 52 during continuous sheet printing and thus, the temperature does not exceeds a constant value. The temperature of the opposed pressure roller 52 is varied by a total sum of an amount of heat given by the fixing roller 51, an amount of heat absorbed when the fixing nip N of a recording sheet S passes, and an amount of heat radiated toward outside. Thus, when a distance between continuously conveyed recording sheets S (a distance between sheets) is increased, the temperature of the pressure roller 52 is increased, and there is a fear that the temperature exceeds 130° C.

Hence, in this embodiment, there is provided a cooling operation mode in which a down sequence for adjusting a fixing temperature is carried out during continuous sheet job.

[Cooling Mode]

Next, a cooling mode for preventing the temperature of the pressure roller 52 from exceeding a set temperature when images are continuously formed on a plurality of recording sheets S will be described.

The image forming apparatus of the embodiment detects the temperature of the fixing roller 51 by the main thermistor 90, and when the temperature is 195° C. or higher or 165° C. or lower, a series of image forming operation is suspended, the pressure roller 52 is separated and the process is shifted to a fixing temperature adjusting operation. When the temperature of the pressure roller 52 exceeds 125° C. (set temperature), the process is also shifted to the fixing temperature adjusting operation.

In the fixing temperature adjusting operation, the fixing roller 51 and the pressure roller 52 are separated for 30 seconds and in this state, the temperature is brought closer to the adjusted temperature by the halogen heater 58 and the cooling fan 80. If the temperature is returned to a predetermined temperature range within 30 seconds, the continuous sheet job is restarted, and if the temperature is not returned to the predetermined temperature range, the fixing temperature adjusting operation is maintained.

In this embodiment, to satisfy the fixing ability, the target adjusting temperature and the productivity (the number of sheets to be printed per unit time) are changed depending upon the environment, the kind of paper and grammage. Therefore, the temperature of the fixing roller 51 does not come out from the above range easily. However, the temperature of the pressure roller 52 can easily exceed the above range because the heat of the fixing roller 51 is transmitted to the pressure roller 52, and if the distance between the continuously conveyed recording sheets S is increased, the temperature of the pressure roller 52 rises. Factors which increase the distance between recording sheets S are a retry caused by supply error from a supply deck, image extension delay from an image processing portion (controller), a discharging sequence of toner from the developing device 1, and wire cleaning of a charger.

For example, this is caused when it takes long time to extend image (lip extension) to convert a large number of image data to write-signals at the image processing portion 300. As the amount of data is greater, or as an image is more complicated, longer image extension time is required when the image processing portion 300 processes image. The same phenomenon occurs when sheets in the sheet cassette 10 run out and the cassette is automatically changed to another sheet cassette 10 (automatic cassette change). An automatic cassette change is an operation for automatically change a sheet cassette 10 which supplies recording sheets S to another sheet cassette 10 when the apparatus has two or more sheet cassettes 10 and when recording sheets S which are recording materials are supplied from the sheet cassette 10, and when the recording sheets S are run out or the number of recording sheets S becomes small, only when the same kind of recording sheets S exists in another sheet cassette 10. When images are formed on two-sides of a small number of sheets by a large-scale apparatus having a long sheet conveying passage, it takes time, in some cases, for fixing an image on a second side through the long sheet conveying passage after an image is fixed on the first side. In this case, first sheet conveying timing and second sheet conveying timing are deviated between images to be formed on both sides of a sheet, and this deviation may increases a distance between recording sheets S more than that of one-sided image forming. There are also other various cases.

There are possibility that these are continuously carried out and they occurs simultaneously, and it is difficult to forecast the timing, and the fixing apparatus 9 can not control the halogen heater 58 and the cooling fan 80 in time.

If downtime is generated in this manner, the productivity is deteriorated and usability is lowered. Hence, in this embodiment, to suppress the speed of temperature rise, the cooling operation mode control is performed. This embodiment includes, as the cooling operation modes, a separation mode for separating the fixing roller 51 and the pressure roller 52 from each other, and a deceleration mode for decelerating the rotation speed of the fixing roller 51 slower than a normal speed when an image is fixed.

When a plurality of recording sheets S are continuously conveyed to form images and the images are fixed, if a leading recording sheet S passes through the fixing apparatus 9, the control circuit 110 determines (calculates) a position of a subsequent recording sheet S, and the control circuit 110 selects the separation mode or the deceleration mode in accordance with the position and executes the same.

Figure 4:
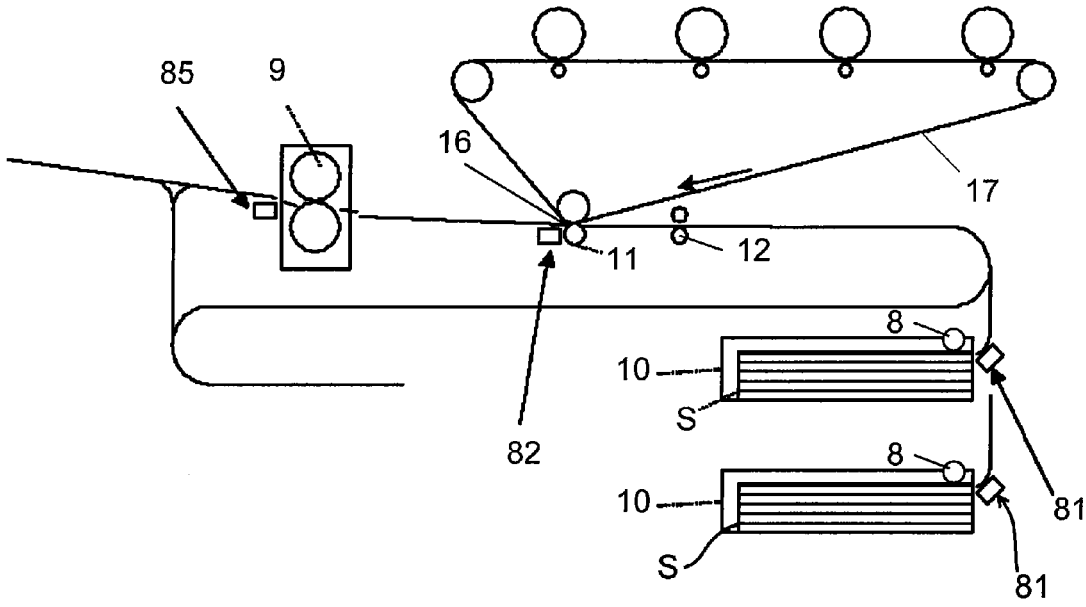
FIG. 4 is a layout drawing of a sheet sensor.

In this embodiment, the separation mode and the deceleration mode are selected based on a position of a conveyed recording sheet S. Hence, as shown in FIG. 4, A first sheet sensor 81, a second sheet sensor 82 and a third sheet sensor 85 which are recording material sensors capable of detecting a recording sheet S are provided near the supply roller 8, the secondary transfer portion 16 and the fixing apparatus 9, respectively and downstream in the recording sheet conveying direction. Further, there are also provided sheet passage counters C1, C2 and C5 (see FIG. 5) which count passage of the recording sheet S when the sheet sensors 81, 82 and 85 detect sheets.

Figure 5:
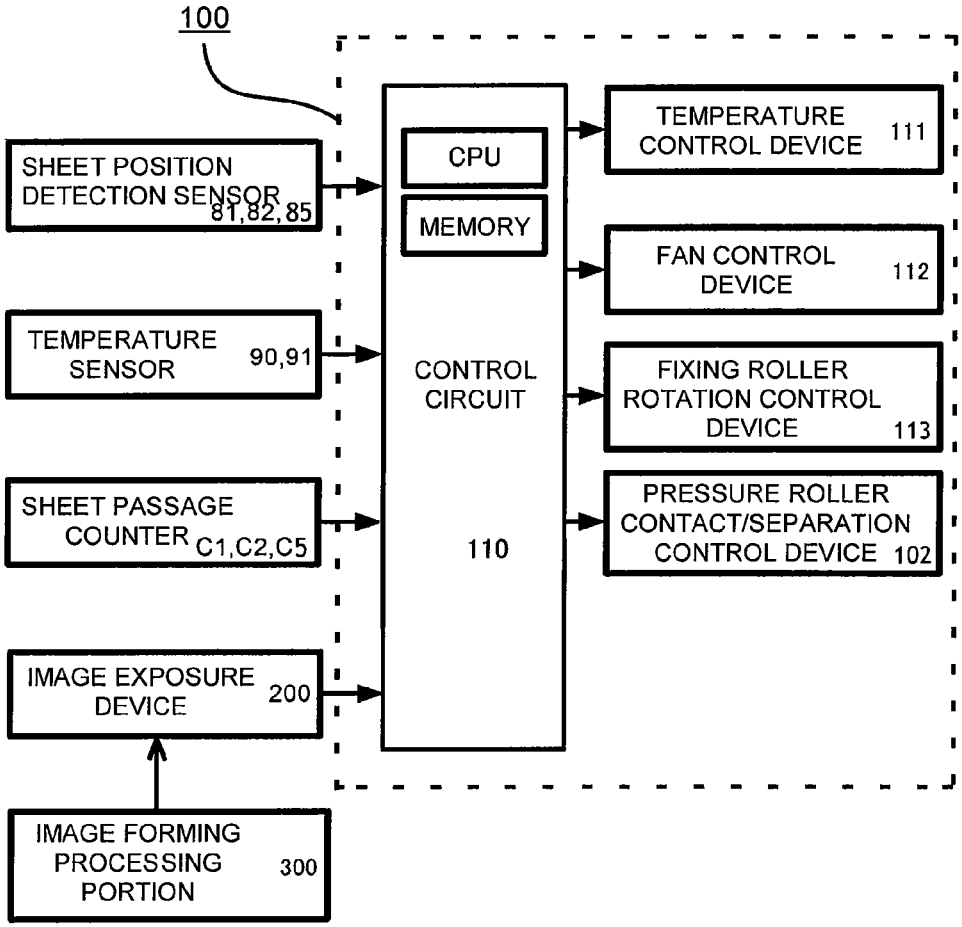
FIG. 5 is a block diagram of a control unit.

FIG. 5 is a block diagram showing a structure of a control unit 100 which is a central control device for driving and controlling various members. As shown in FIG. 5, detection signals from temperature sensors (thermistors) 90 and 91 and from the sheet sensors 81, 82 and 85, and counted values of the sheet passage counters C1, C2 and C5 are input to a control circuit 110 including a CPU and a memory. The control circuit 110 drives and controls a temperature control device 111 which controls the driving of the halogen heater 58 and a fan control device 112 which controls the driving of a fan based on a temperature detection signal. The control circuit 110 sends commands to the pressure roller contact/separation control device 102 which controls the driving of the contact/separation mechanism 95 based on a sheet detection signal or a sheet passage counted value, and to the fixing roller rotation control device 113 which controls a rotation speed of the fixing roller 51. With this, the various members are driven and the modes are executed.

Figure 6:
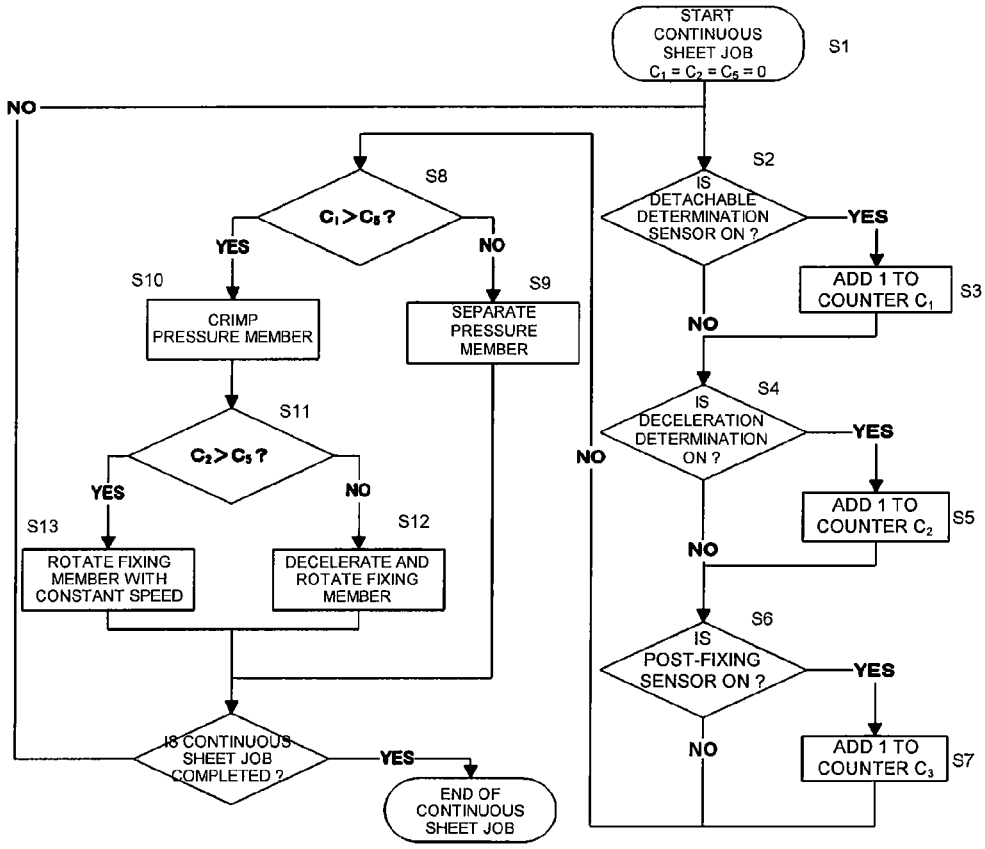
FIG. 6 is a flowchart showing a processing operation.

Next, the operation of the cooling mode which is selected and executed by the control unit (execution unit) 100 will be described with reference to the flowchart in FIG. 6.

When the continuous sheet job is started, initial values of the sheet passage counters C1, C2 and C5 are reset to 0 (S1).

After the print job is started, time at which a tip end of a sheet conveyed by the supply roller 8 is detected by the first sheet sensor 81 is defined as T1, and 1 is added to the counter C1 (S2 and S3). Simultaneously, time at which a tip end of a conveyed sheet is detected by the second sheet sensor 82 is defined as T2, and 1 is added to the counter C2 (S4 and S5). Further, time at which a tip end of a conveyed sheet is detected by the third sheet sensor 85 is defined as T5, and 1 is added to the counter C5 (S6 and S7).

A sheet conveying distance of the image forming apparatus of the embodiment from a pickup position from the sheet cassette 10 of sheets to the fixing apparatus 9 is about 1.2 m, and a sheet conveying speed is 200 mm/s. Therefore, a sheet reaches the fixing apparatus 9 in about six seconds from time T1 at which a tip end of a sheet passes through the first sheet sensor 81. Similarly, since a sheet conveying distance from the secondary transfer portion 16 to the fixing apparatus 9 is 0.5 m, a sheet reaches the fixing apparatus 9 in 2.5 seconds from time T2. If it takes two seconds for a A3 sheet to pass through the fixing nip N, time elapsed until time T5 at which a sheet passes through the fixing apparatus 9 after it reaches the fixing apparatus 9 is about two seconds.

Further, in the image forming apparatus of the embodiment as shown in FIG. 7, it takes two seconds to separate the fixing roller 51 and the pressure roller 52 in their crimped state by the separation mode. It takes three seconds to crimp the separated pressure roller 52 and fixing roller 51 other and to stably rotate. It takes at least five seconds for a series of operations (separation mode possible time Ta) for separating the fixing roller 51 and pressure roller 52 in their crimped state by the separation mode and then for again crimping the separated pressure roller 52 and fixing roller 51 each other and stably rotating.

Further, according to the image forming apparatus of the embodiment, as shown in FIG. 7, it takes one second to decelerate the fixing roller 51 which is rotating at normal speed of 200 mm/s at the time of image fixing operation by the deceleration mode to 50 mm/s (¼ of 200 mm/s). It also takes one second to accelerate from 50 mm/s to 200 mm/s again. Therefore, deceleration mode possible time Tb for decelerating the fixing roller 51 which is rotating at the normal speed by the deceleration mode, and returning the fixing roller 51 to the normal speed again is at least two seconds.

Reaching time elapsed after a leading recording sheet S passes through the fixing apparatus 9, i.e., through the fixing nip N until a subsequent recording sheet S reaches the fixing apparatus 9, i.e., the fixing nip N is defined as Tc. With this, above time relation can be summarized as follows. Meanwhile, the control unit 100 calculates time Tc based on output from the sheet passage counter. That is, in this embodiment, the control unit 100 also functions as a calculating unit for calculating time Tc.

(1) When a subsequent recording sheet S is located upstream of the first sheet sensor 81, since Tc>6 seconds, Tc>Ta.

(2) When a subsequent recording sheet S is located downstream of the first sheet sensor 81 and upstream of the second sheet sensor 82, since Tc>2.5 seconds, Tc>Tb.

(3) When a subsequent recording sheet S is located downstream of the second sheet sensor 82 and upstream of the third sheet sensor 85, since Tc>2.5 seconds, there is a probability that Tc<Tb.

In the image forming apparatus of the embodiment, Ta is set greater than Tb (Ta>Tb). One of the separation mode and the deceleration mode is selected and executed depending upon which location a subsequent recording sheet S is located after a leading recording sheet S passes through the fixing nip N. In this embodiment, the mode is selected in the procedure shown in the flowchart in FIG. 6 by values of the counters C1, C2 and C5.

Figure 8:
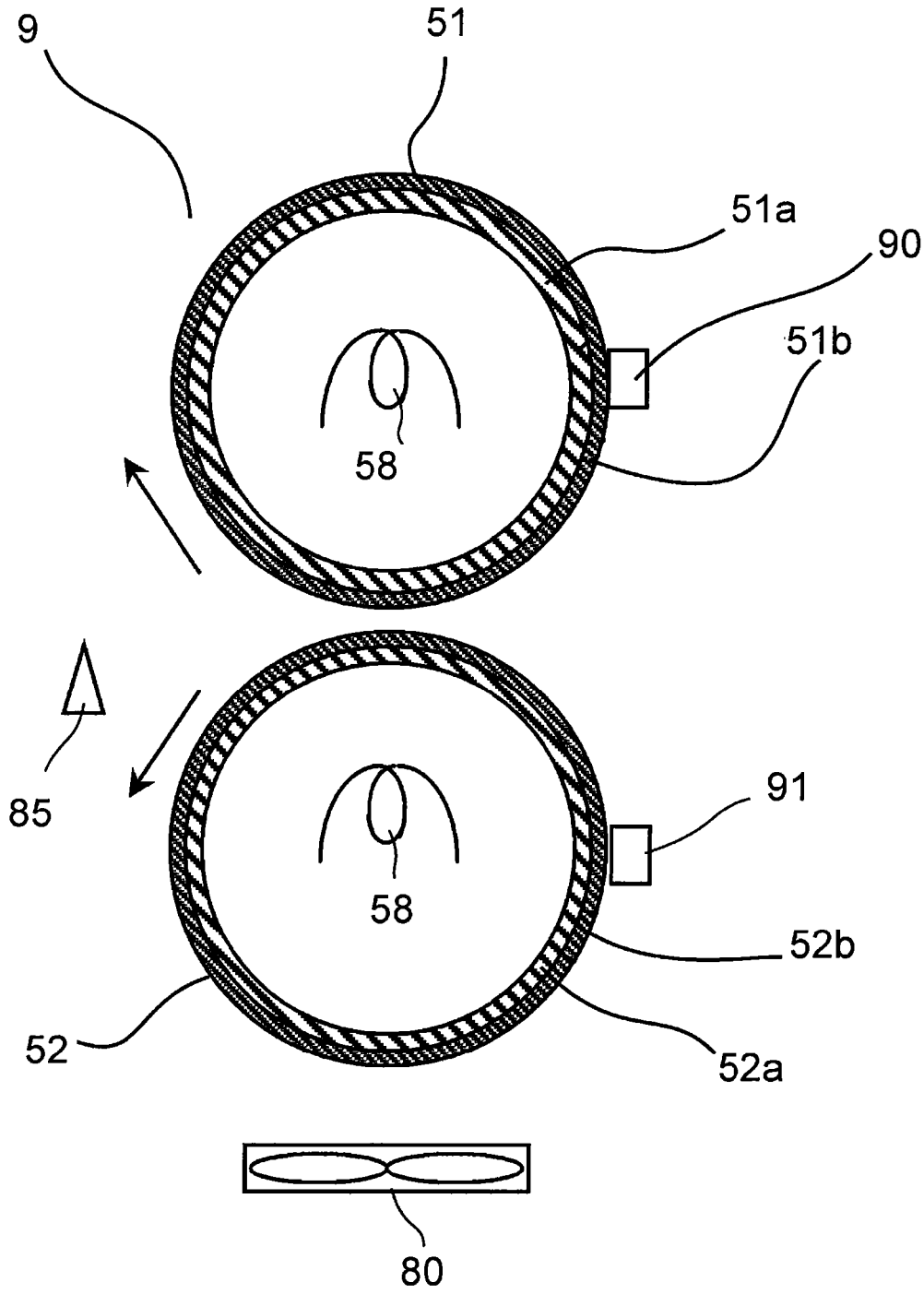
FIG. 8 is a sectional view of a fixing apparatus at the time of a separating operation.

(1) When C1=C5 (when a subsequent sheet is located upstream of the first sheet sensor 81), since Tc>Ta, the control unit executes the separation mode, and the pressure roller 52 separates from the fixing roller 51 as shown in FIG. 8 (S8, S9). Next, when C1 becomes greater than C5 (C1>C5), i.e., when the tip end of a recording sheet passes through the first sheet sensor 81, a command for carrying out the crimp operation is output.

Figure 9:
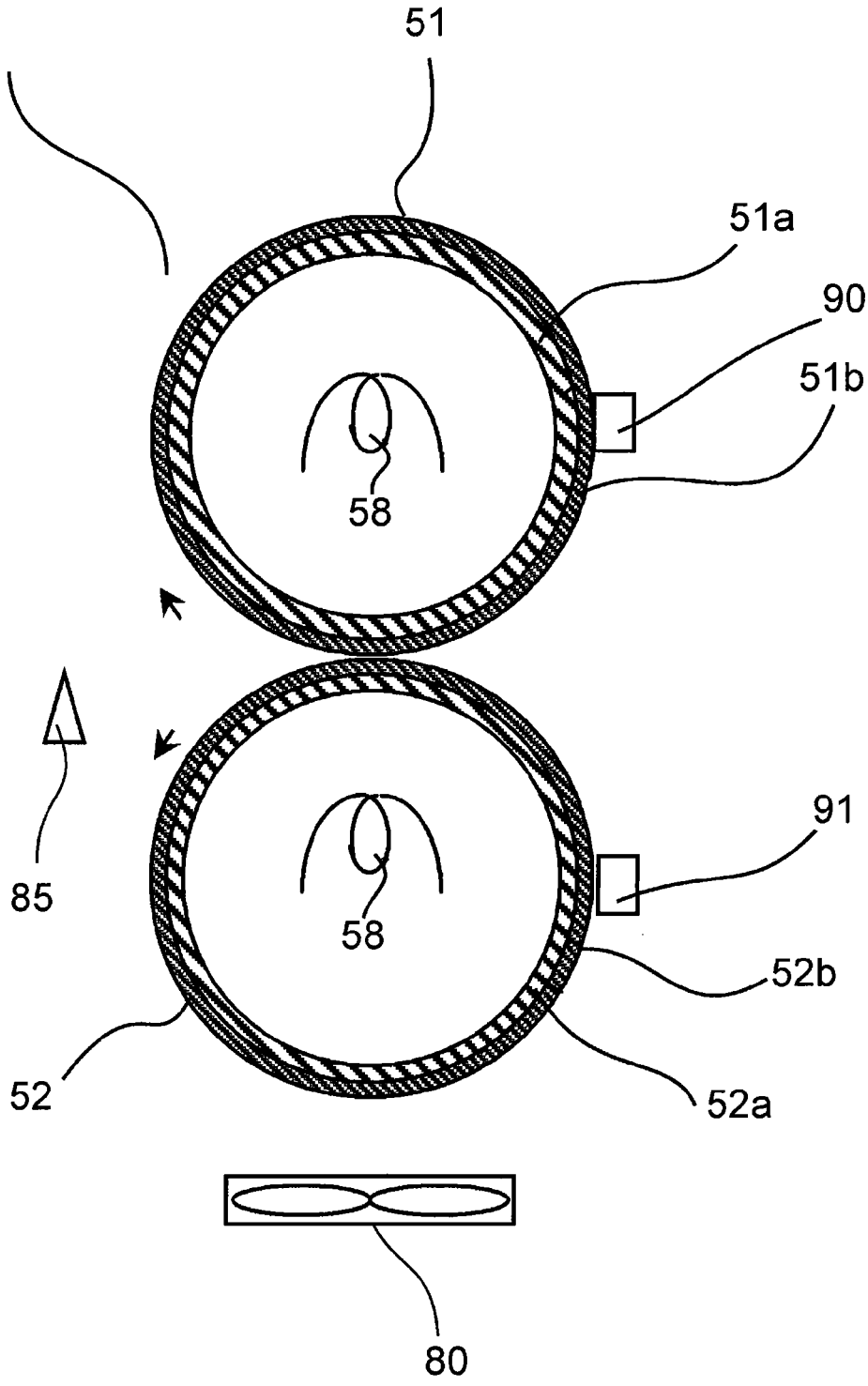
FIG. 9 is a sectional view of the fixing apparatus showing a deceleration mode.

(2) When C1>C2=C5 (when a subsequent sheet is located downstream of the first sheet sensor 81 and upstream of the second sheet sensor 82), since Ta>Tc>Tb, the control unit maintain the pressurizing operation of the pressure roller 52 and the fixing roller 51 as shown in FIG. 9, and the deceleration mode is executed. That is, the rotation speed of the fixing roller 51 is reduced from 200 mm/s to 50 mm/s (S10 to S12). Then, when C2 becomes greater than C5 (C2>C5), i.e., when the tip end of a sheet passes through the second sheet sensor 82, the rotation speed is returned to 200 mm/s.

(3) When C2>C5 (when a subsequent sheet is located downstream of the second sheet sensor 82 and upstream of the third sheet sensor 85), since there is a possibility that Tc<Tb, the control unit 100 does not execute separation mode or deceleration mode, but selects and executes the constant mode. More specifically, a state where the fixing roller 51 and the pressure roller 52 crimp each other is maintained, and the rotation at the same peripheral speed as that of the fixing operation (S13). That is, in this embodiment, the constant mode is prepared in addition to the separation mode and the deceleration mode, and the control unit can select and execute one of the plurality of modes including these modes.

When there is no room to execute the deceleration mode (when C2>C5), the constant mode is selected. However, since no recording sheet S existed in the fixing nip N and time during which the pressure roller 52 was heated by the fixing roller 53 was short, the temperature of the pressure roller 52 did not exceed the set temperature.

When recording sheets S are continuously conveyed and images are formed and fixed thereon, if a leading recording sheet S passes through the fixing apparatus 9, the separation mode, the deceleration mode or the constant mode is selected and executed in accordance with a position of a subsequent recording sheet S. This selection is made by determining the arrival time at which the subsequent recording sheet S arrives at the fixing apparatus 9 based on a sheet detection signal which is output by the sheet sensor (detection unit).

Figure 10:
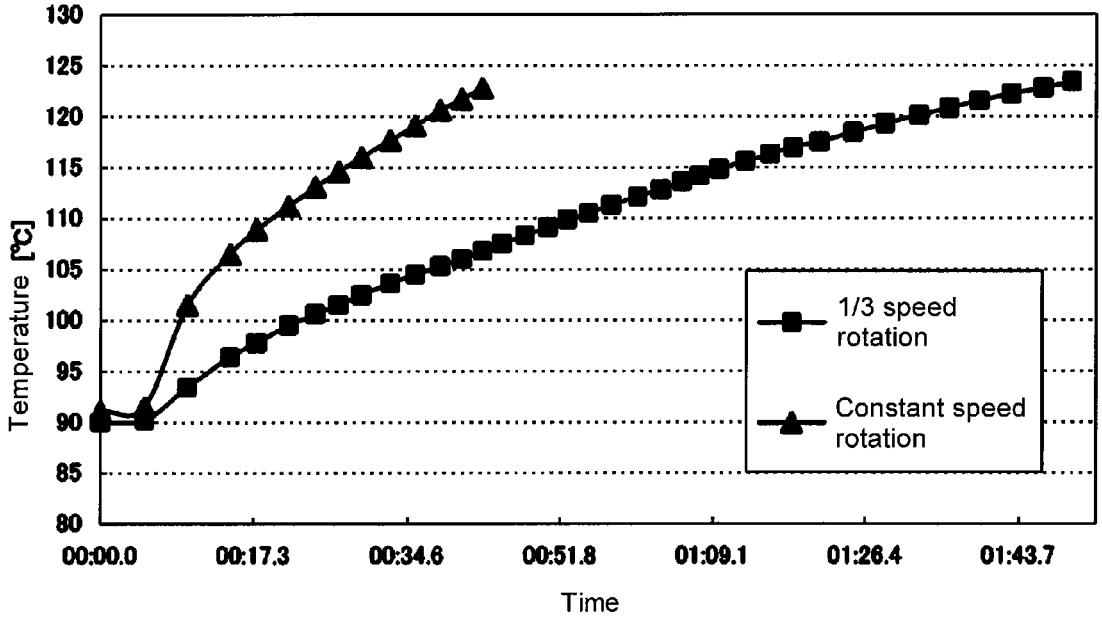
FIG. 10 shows a result of study of effect of the deceleration mode.

FIG. 10 is a graph showing experiment results of a temperature transition when the fixing apparatus 9 of the embodiment is heated by a heater in a state where the fixing roller 51 and the pressure roller 52 crimp each other and it is rotated at a constant speed at normal speed when an image is fixed, and when it is decelerated to ⅓ peripheral speed thereof.

As show in FIG. 10, a temperature reduction speed of the fixing roller 51 and a temperature rising speed of the pressure roller 52 become gentle by decelerating the rotation speed of the fixing roller 51.

This is because that when heat is transmitted to the pressure roller 52 from the fixing roller 51, the transmission speed of heat is increased if a stat wherein a difference in temperature therebetween is always high is maintained, but a transmission speed of heat becomes more gentle as the temperatures thereof approach the balanced state. This is the same reason as that of the fact that if an amount of wind of the cooling fan 80 is increased, a subject is cooled more effectively. That is, if the rotation speed of the fixing roller 51 is made lower than that of the fixing operation, a difference in temperature of the fixing roller 51 and of the fixing nip N with which the pressure roller 52 come into contact is reduced, and the transmission speed of heat is reduced. In a stationary state, the transmission of temperature becomes the slowest.

FIG. 11 shows experiment results of heat transmission to the 52 when the fixing roller 51 is rotated at a constant speed at a normal speed when image is fixed, when the fixing roller 51 is rotated at a peripheral speed of ⅔ of the normal speed, when the fixing roller 51 is rotated at a peripheral speed of ⅓ of the normal speed, and when the fixing roller 51 is stopped. From the results, it is found that as the peripheral speed of the fixing roller 51 is lower, the transmission speed of heat becomes gentler.

In the embodiment, the fixing apparatus 9 is operated in the cooling operation mode in accordance with the conveyance state of recording sheets S. With this, interruption control is performed during continuous sheet job, a distance is frequently increased, the temperature of the pressure roller 52 is about 120° C. at the maximum and there was no downtime.

In this embodiment, the temperature transmission to the pressure roller 52 between sheets with which the fixing roller 51 and the pressure roller 52 come into direct contact which is the largest cause of downtime can be reduced, and it is possible to minimize the temperature rise of the pressure roller 52. Therefore, it was possible to largely reduce the number of downtime caused due to temperature rise of the pressure roller 52 during print job.

Figure 12:
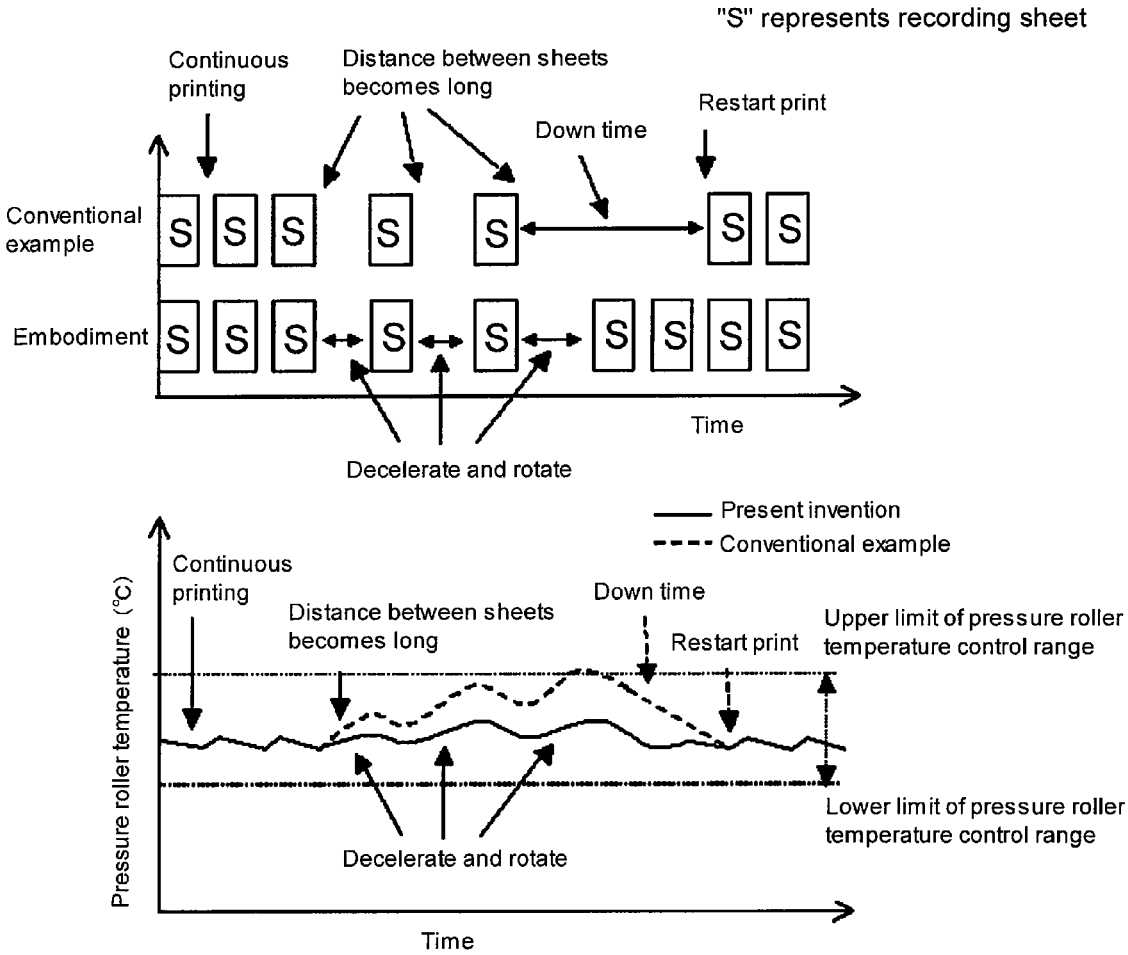
FIG. 12 is a diagram for illustrating effect of the deceleration mode.
Figure 13:
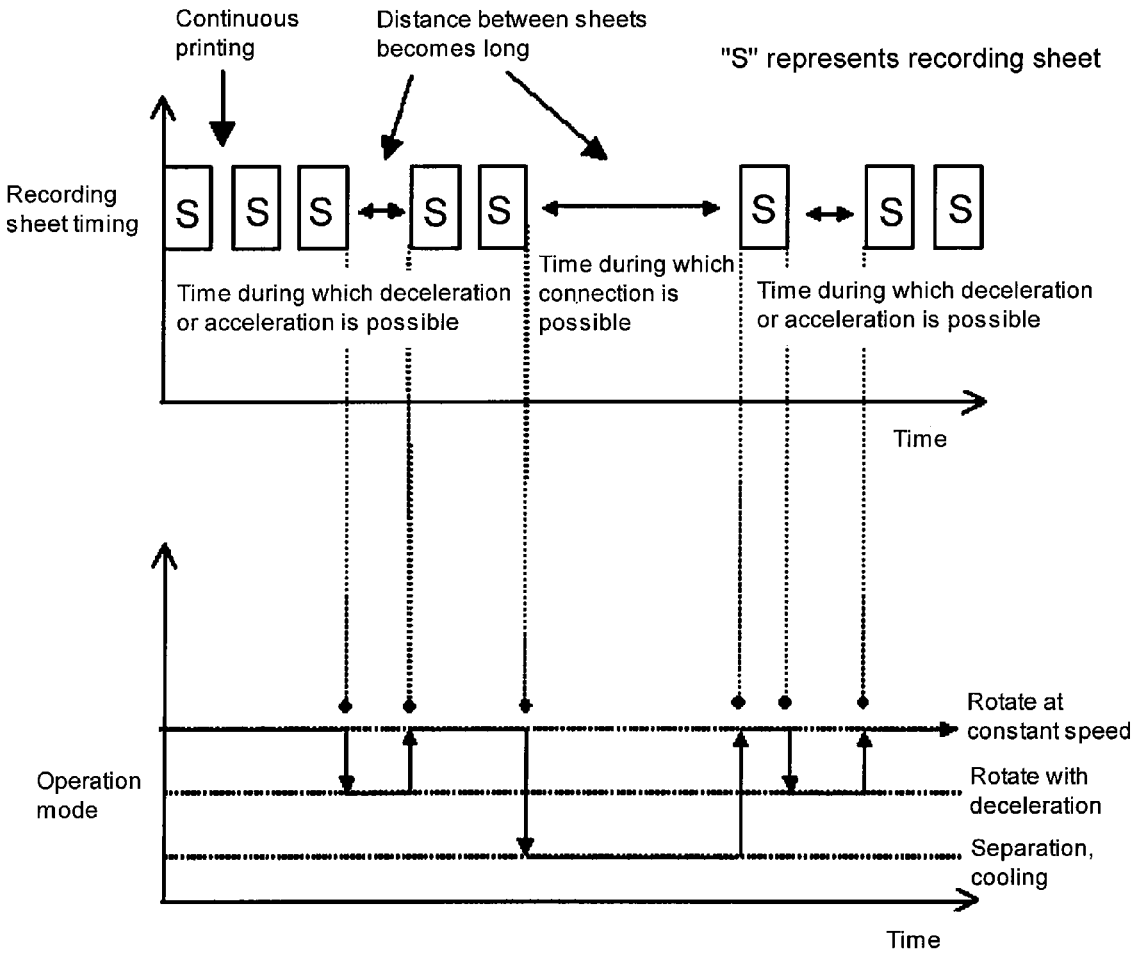
FIG. 13 is a diagram for illustrating motion of the deceleration mode.

FIGS. 12 and 13 show operation image of the fixing apparatus 9. As shown in FIG. 12, in the conventional technique, if the temperature of the pressure roller 52 is largely increased when a distance between sheets is increased and this is repeated, it reaches the upper limit of the temperature control range of the pressure roller 52, and the procedure enters the down sequence.

In the embodiment, however, the temperature rise when a distance between sheets is increased is minimized by deceleration rotation of the fixing roller 51. The temperature rise speed of the pressure roller 52 became gentle only with the deceleration mode, but the temperature which once increased in a state where no sheet was conveyed to the fixing apparatus 9 was not reduced. Hence, as shown in FIG. 13, when a distance between sheets from which the pressure roller 52 can be detached is increased, the pressure roller 52 is separated from the fixing roller 51 and is cooled, and the increased temperature of the pressure roller 52 is returned to the original value.

In the embodiment, to avoid a case in which the number of sensors was increased and the structure became complicated, a registration sensor, a sensor of the secondary transfer portion 16 and a pre-fixing sensor were utilized as they were, and the contact/separation timing of the pressure roller 52 and acceleration/deceleration timing of the fixing roller 51 were determined. However, if a flag of the sensor is provided at appropriate timing position of a sheet while taking separation/crimp time of the pressure roller 52 and deceleration/acceleration time of the fixing roller 51 into account, the temperature rise preventing effect of the pressure roller 52 which is a target is enhanced.

Figure 14:
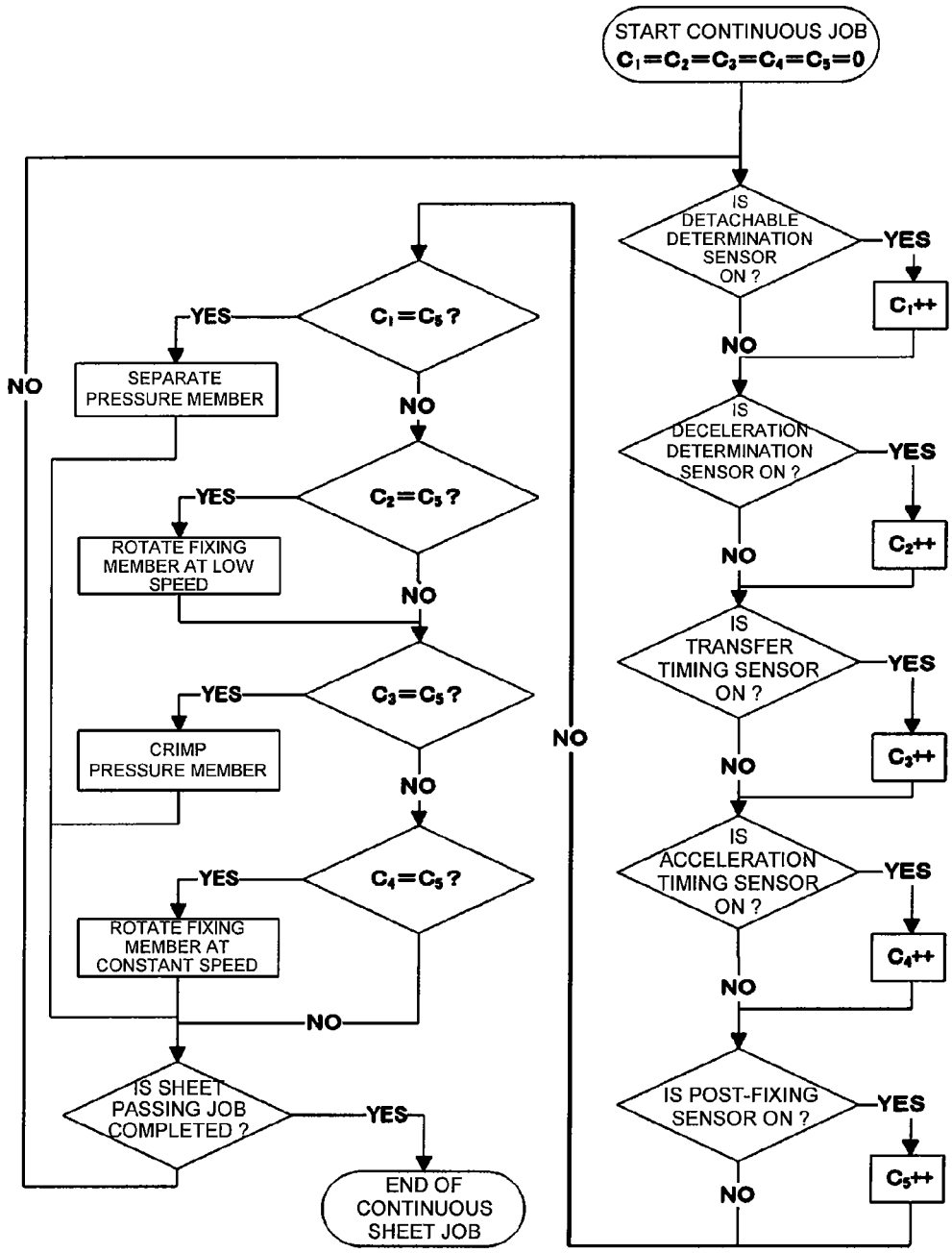
FIG. 14 is a flowchart showing a processing operation.

An arrival timing sensor which detects that a recording sheet S is conveyed to a position where the pressure roller 52 crimps the separated fixing roller 51 in time is provided. An acceleration timing sensor which detects that a recording sheet S is conveyed to a position where the decelerating fixing roller 51 accelerates to the normal speed in time is provided. As shown in a flowchart in FIG. 14, the separation mode or the deceleration mode is selected and executed based on values of the counters C3 and C4 which count a recording sheet S which passes the arrival timing sensor and the acceleration timing sensor. With this, as shown in FIG. 15, the low speed rotation is carried out in a period during which no recording sheet S exists in the fixing apparatus 9, the effect for preventing the temperature from increasing more than the set temperature is further enhanced.

From FIG. 11, it is found that as the rotation speed of the fixing roller 51 at the time of deceleration mode is reduced, the temperature rise speed of the pressure roller 52 is suppressed. With a speed faster than ⅔ of the normal time, effect can not be expected almost at all, the temperature of the pressure roller 52 is increased as in the conventional technique and the procedure enters downtime.

In a state close to the stationary state, on the contrary, variation in temperature distribution is generated in surfaces of the fixing roller 51 and the pressure roller 52. Hence, variation in fixing performance of images after fixing operation and variation in surface gloss were generated. In the structure of the embodiment, if the number of revolutions of the motor was about 10%, since the nip pressure of the fixing apparatus 9 was high as about 1000 N and the performance of the driving motor was limited, rotation failure and slip were generated in a slide member between the fixing nips N.

From the above results, it is preferable that the rotation speed of the fixing roller 51 in the deceleration mode is 1/10 or higher and ⅔ or lower of the rotation speed at the time of the normal fixing operation.

Second Embodiment

Next, an apparatus according to a second embodiment will be described. Since the basic structure of the apparatus in the embodiment is the same as that of the previous embodiment, explanation thereof will be omitted, and a structure of a feature of the embodiment will be described. Members having the same functions as those of the previous embodiment are designated with the same symbols.

In the first embodiment, the plurality of sheet sensors 81, 82 and 85 are provided in the sheet conveying passage, and crimp, separating timing of the pressure roller 52 and acceleration/deceleration timing of the fixing roller 51 were determined.

In the embodiment, an image formation starting signal is sent from the image forming processing portion (controller) 300 to the image exposure apparatus 200, and time at which a recording sheet S reaches the secondary transfer portion 16 is obtained from the image writing timing at which the image exposure apparatus 200 starts the forming operation of the electrostatic image on the photosensitive drum 3. The arrival timing to the fixing roller 51 is calculated from the secondary transfer portion 16, and the separation mode, the deceleration mode or the constant mode is selected and determined.

Figure 16:
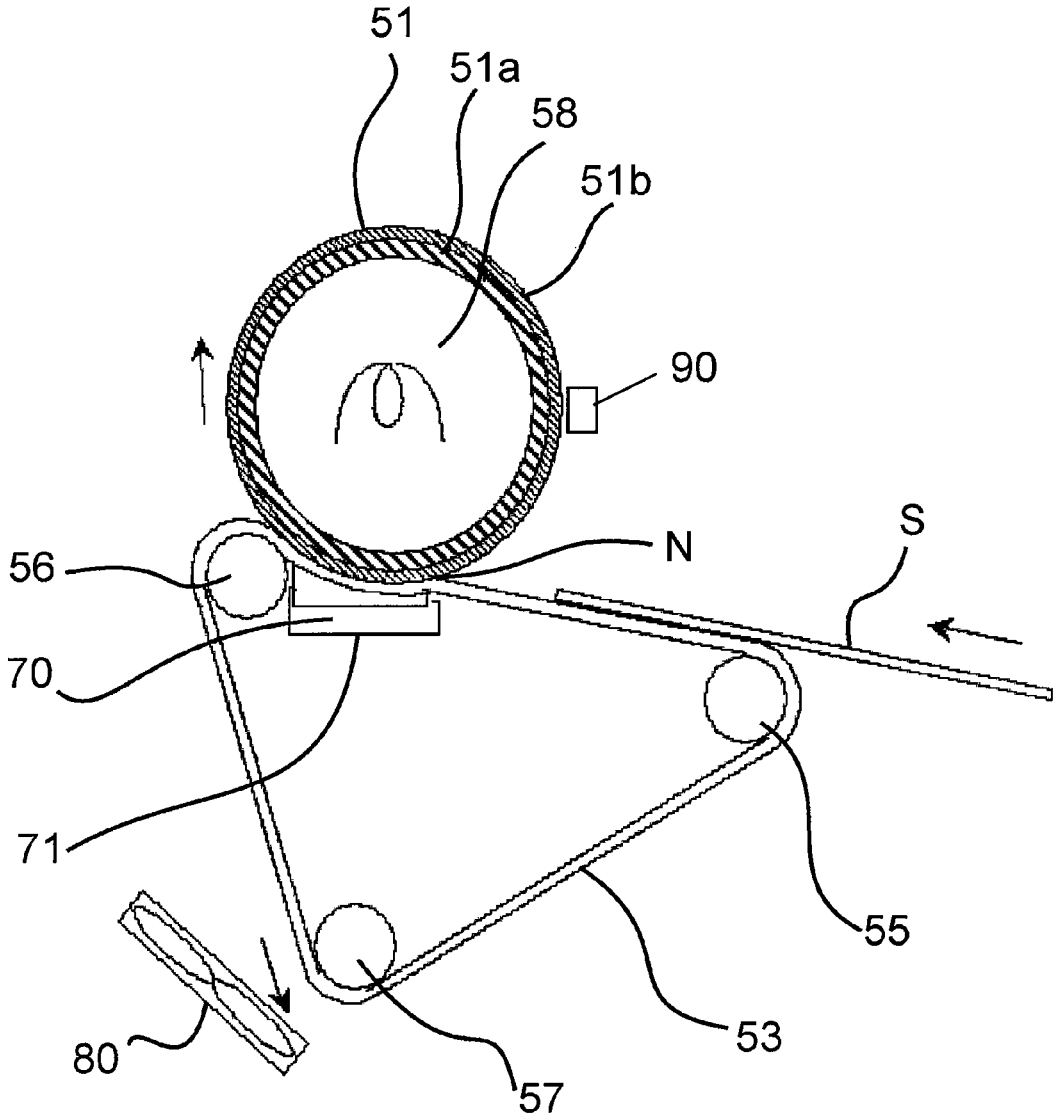
FIG. 16 is a sectional view of a fixing apparatus according to a second embodiment.

In the embodiment, as shown in FIG. 16, a belt type fixing apparatus 9 using an endless belt is used as the fixing apparatus 9.

That is, in this embodiment, as shown in FIG. 16, an endless pressure belt (pressure rotating member) 53 wound around a plurality of rollers 55, 56 and 57 is used instead of one of the pressure rollers of the pair of fixing rotating members. The pressure belt 53 abuts against the fixing roller (fixing rotating member) 51, the pressure member comprising a pressure pad 70 and a pressure pad support portion 71 pressurizes the pressure belt 53 against the fixing roller 51 through a slide member (not shown) from inside of the pressure belt 53, thereby forming the fixing nip.

The fixing roller 51 is rotated and driven in a direction of the arrow in FIG. 16 (clockwise direction). The pressure belt 53 comes into contact with a surface of a recording sheet opposite from a surface of the recording sheet on which a non-fixed toner image is formed, and it is rotated in the direction of the arrow (counterclockwise direction) so as to follow the rotation of the fixing roller 51.

The fixing roller 51 has an Al core metal which has 3 mm thickness and which is coated with elastic body layer such as silicone rubber and fluoro-rubber. The elastic layer may be coated with fluoroplastics such as PFA tube having 10 to 100 μm as a surface layer.

The pressure belt 53 has a base material made of resin such as polyimide or metal such as nickel coated with elastic body layer such as silicone rubber or fluoro-rubber, and may be coated with fluoroplastics such as PFA tube having 10 to 100 μm thickness as a surface layer.

The pressure belt 53 is wound around the rollers 55, 56 and 57. Among them, the roller 56 is a separation roller made of metal, and the roller 56 pressurizes such that it bites into the fixing roller 51 through the pressure belt 53. With this, the elastic body of the fixing roller 51 is deformed and a recording sheet S is separated from a surface of the fixing roller 51.

The pressure pad 70 employs a structure in which an elastic body such as silicone rubber and fluoro-rubber is disposed on a metal base. The pressure pad 70 pressurizes the pressure belt 53 and the fixing roller 51. It is general that a slid member for enhancing sliding ability is used between the pressure pad 70 and the pressure belt 53 or lubricant is used on an inner surface of the pressure belt 53.

If the fixing nip N is formed by the fixing roller 51, the endless pressure belt 53 and the pressure pad 70, it is possible to form a wide fixing nip N such that it is wound around an outer periphery of the fixing roller 51 by the pressure belt 53. This is advantageous for increasing speed and for fixing of thick paper.

If a separation roller 56 is pressurized such that it bites into a surface of the fixing roller 51, better separating performance than that of the first embodiment is obtained and this is advantageous for speedup.

This embodiment employs a structure in which the pressure pad 70 is slid on the pressure belt 53 and is pressurized. Therefore, there is a fear that slip is generated due to sliding resistance of the pressure belt 53. The sliding resistance of the pressure belt 53 is increased as the temperatures of the slide member of the pressure pad 70 and the pressure belt 53. Therefore, in order not to generate slip of the pressure belt 53, it is important to maintain the temperature of the pressure belt 53 at a low level.

From such a point of view, it is necessary to separate the belt between sheets in the belt fixing apparatus 9 of this embodiment. As countermeasures against temperature rise during the print job, the cooling mode of the pressure belt 53 is effective.

Hence, the fixing apparatus 9 of the embodiment is also constituted such that the pressure belt 53 can crimp and separate from the fixing roller 51 by the contact/separation mechanism 95. The operation of the contact/separation mechanism 95 is controlled by the control unit 100.

[Cooling Mode]

Next, the cooling mode for preventing the temperature of the pressure belt from exceeding the set temperature when images are continuously formed on a plurality of recording sheets S will be described. In this embodiment also, the control unit 100 controls execution timing of selection of the cooling mode.

In the cooling mode of the embodiment, arrival time Tc of a recording sheet S at the fixing apparatus 9 is determined from the image writing timing, and if the time is greater than the separation mode possible time Ta, the separation mode is executed to separate the pressure belt 53 from the fixing roller 51. If the arrival time is shorter than the separation mode possible time and longer than the deceleration mode possible time Tb, the deceleration mode is executed to reduce the rotation speed of the fixing roller 51, and the temperature rise of the pressure belt 53 is minimized.

With this, generation of slip of the pressure belt 53 is suppressed, productivity when sheets are continuously supplied is secured, and reduction of usability caused by hot offset or downtime by abnormal temperature rise of the pressure belt 53 is prevented.

In the image forming apparatus, based on the image writing timing at which an electrostatic image is formed by image exposure on the photosensitive drum 3, time during which a recording sheet S on which toner is transfer is conveyed and finally arrives at the fixing apparatus 9 is always constant if the print job is the same. Hence, time during which a recording sheet S arrives at the fixing apparatus 9 can be calculated based on the image writing timing.

When a next print job is sent to the image forming apparatus 1000 during execution of an old print job, the image forming operations on the recording sheets S of the currently executed print job and a next print job are continuously carried out. However, when the amount of image data of the next print job is high, time required for converting the image data by the image forming processing portion 300 becomes long, and the image writing timing of the image exposure apparatus 200 is delayed. That is, when the amount of image data of the next print job is high, the image writing timing is delayed, and a distance between a recording sheet S on which an image of the currently executed print job is lastly formed and a first recording sheet S of the next print job becomes long. In this manner, time between sheets elapsed until the first recording sheet S on which an image is to be formed by the next print job reaches the fixing nip N after a recording sheet S on which an image is formed lastly by the currently executed print job is varied. In this embodiment, the control unit (calculating unit) 100 calculates time at which a recording sheet S reaches the fixing nip N based on the image writing timing. The control unit 100 selects one of the deceleration mode, the separation mode and the constant mode based on a difference between time at which the last recording material sheet S of the next print job reaches the fixing nip N and time at which the last recording sheet S of the currently executed print job passes through the fixing nip N.

In this embodiment, when forming an image of four colors, the arrival timing of a recording sheet S at the fixing apparatus 9 was determined based on image writing timing of yellow located most upstream. After the continuous sheet job is started, an image writing command is sent from the control unit to the image forming portion. If the image writing of yellow on the photosensitive drum 3*a* is detected, a storing device sequentially stores the time. The processing is carried out by procedure shown in a flowchart in FIG. 17.

Although the yellow image writing timing is used as the reference in the embodiment, if the separation timing of the pressure belt 53 with respect to the fixing roller 51 and detection timing of temperature rise preventing mode match, image writing timing of another color (e.g., black) may be used without any problem.

Figure 17:
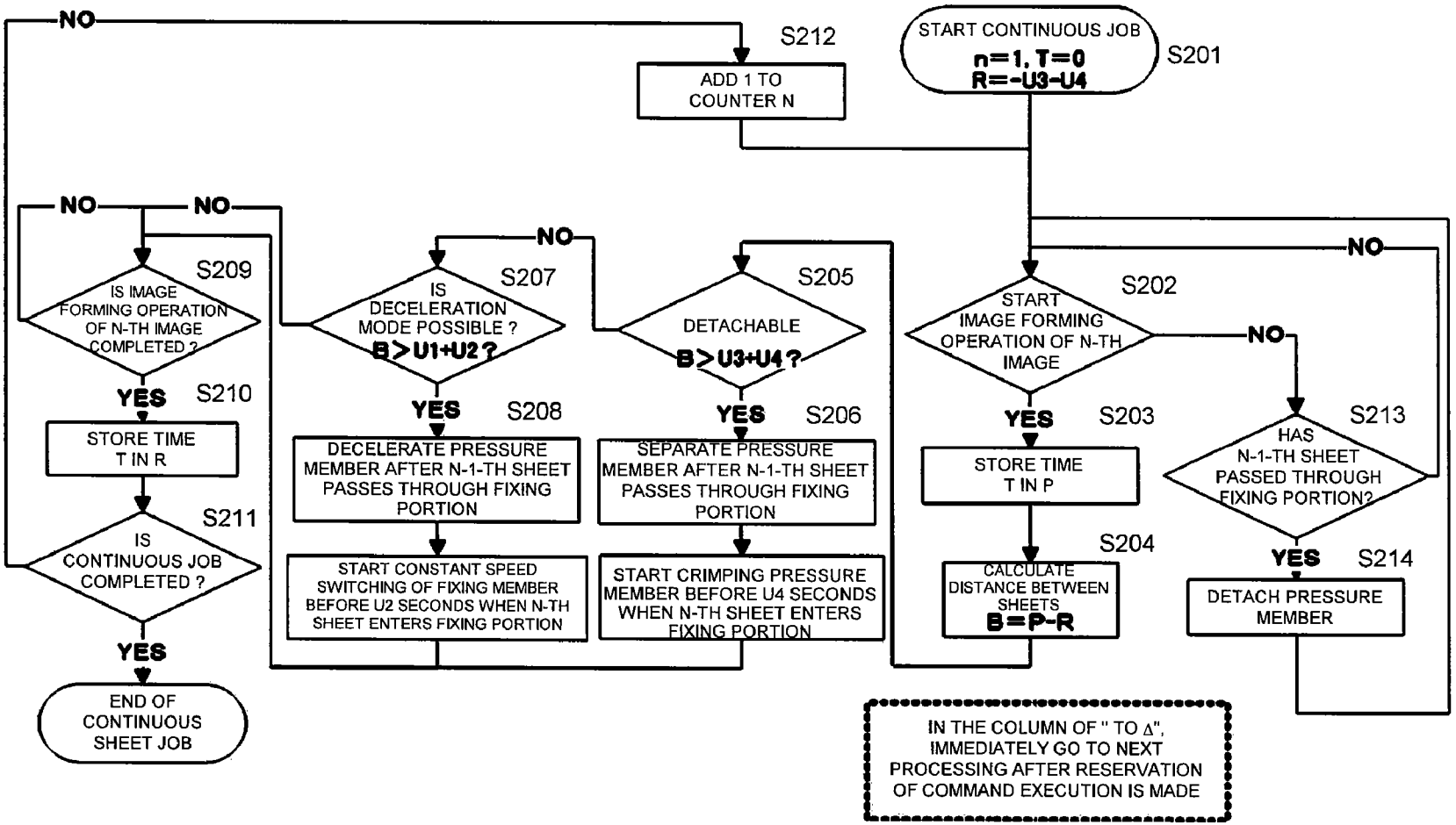
FIG. 17 is a flowchart showing a processing operation according to the second embodiment.
Figure 19:
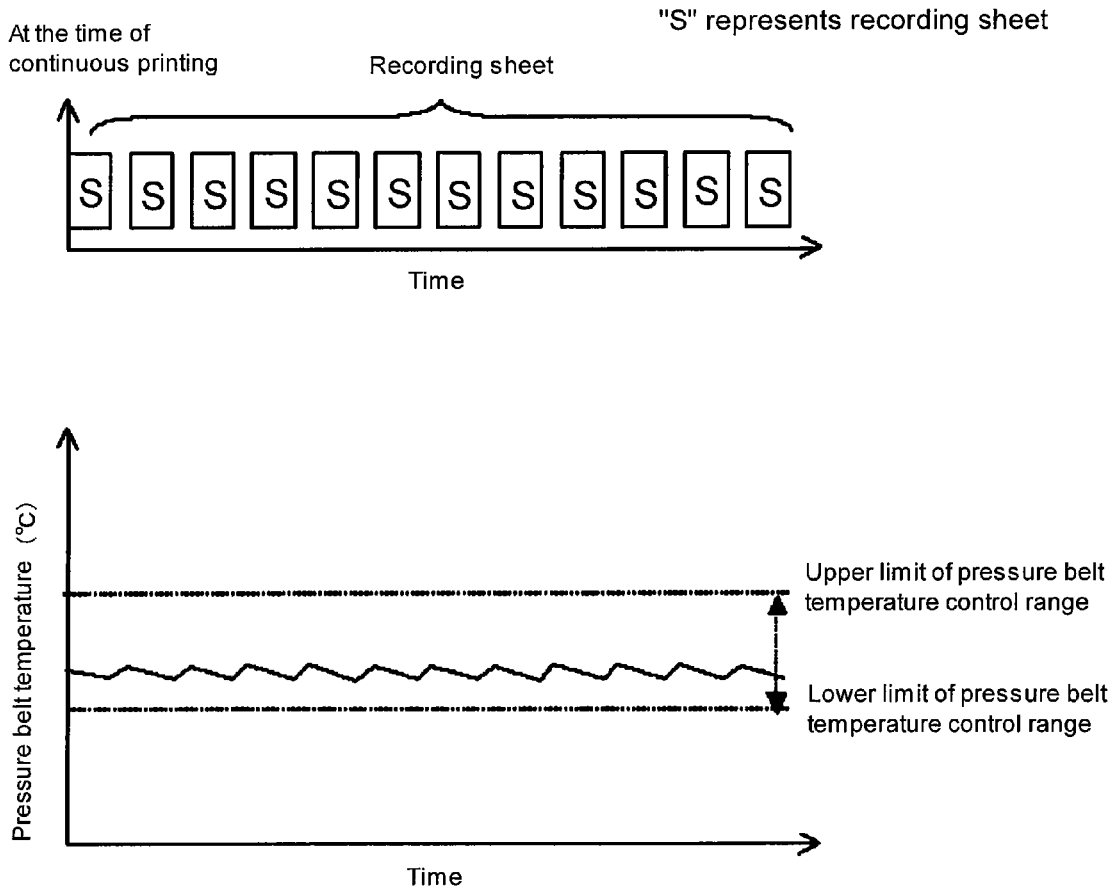
FIG. 19 is a diagram for illustrating a state when a continuous sheet is conveyed.
Figure 20:
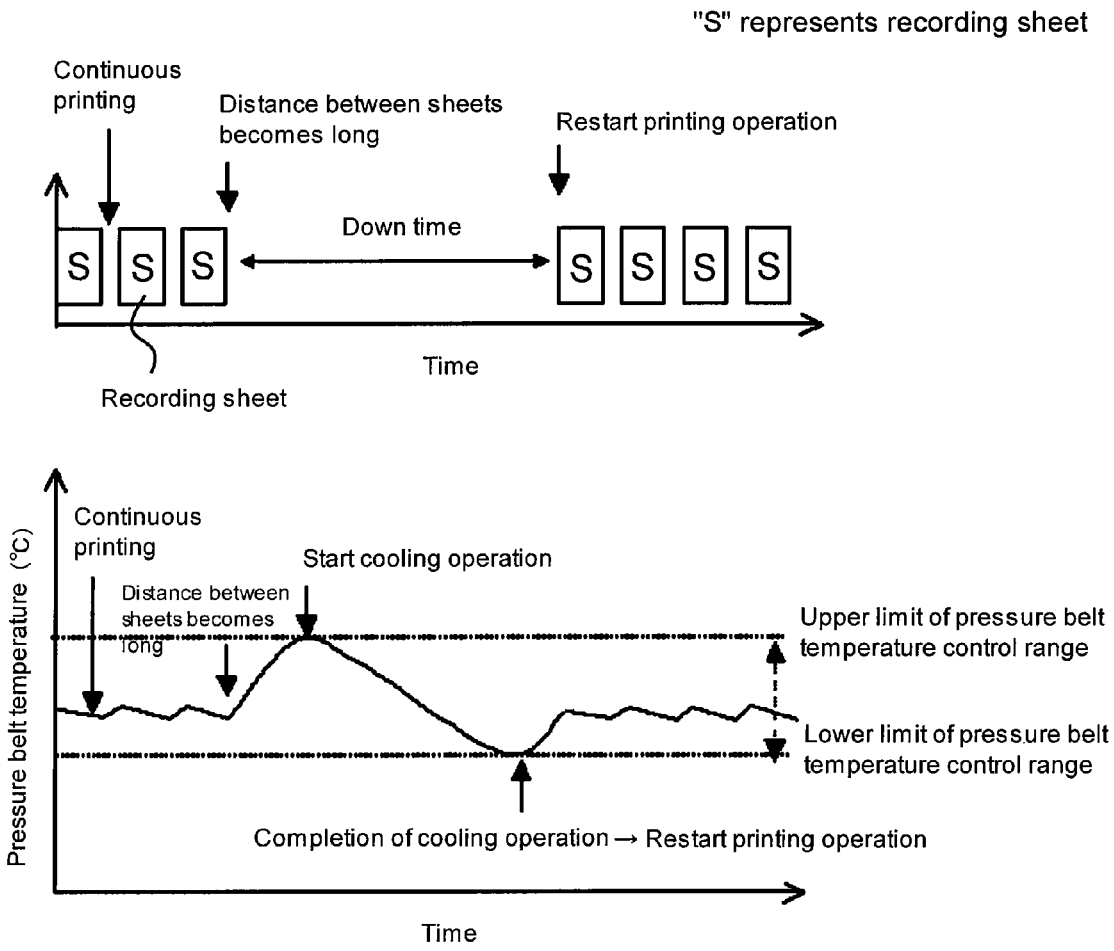
FIG. 20 is a diagram for illustrating a state when a continuous sheet is conveyed.

The actual operation advances with a flow of the flowchart in FIG. 17. The temperature rise preventing mode will be described with reference to the flowchart.

Symbols U1, U2, U3 and U4 in the flowchart represent maximum necessary time required for changing the modes as shown in FIG. 18. In this embodiment, U1=1 second, U2=1 second, U3=2 seconds and U4=3 seconds. Further, n represents the number of sheets on which an image in a job should be written, T represents time elapsed after a job is started, R represents time at which image formation is completed, P represent time at which image formation is started, and B represents time between sheets obtained from P-R.

If the continuous sheet job is received, an image writing executing number of sheets variable n is initialized to 1, an elapsed time variable T is initialized to 0, and T is increased with the elapsed time. A value of initial R is set to a value which is equal to or lower than −(U3+U4) because there is no image which is written before the first image (S201).

Next, when the image formation is started and at the timing in which an electrostatic image of an image signal is formed on the photosensitive drum 3 (S202), time T is stored in P (S203) and a distance B between sheets is calculated (S204).

A reservation for separating (detaching) the pressure belt 53 is made when the value B is greater than time U3+U4 required for separating/crimping (attaching/detaching) of the pressure belt 53 (when the pressure belt 53 can be separated and crimped within time between sheets) (S205), and when a recording sheet S on which an image was formed before 1 passed through the fixing apparatus 9. A reservation for starting the crimping operation (arrival) of the pressure belt 53 is made (S206) before U4 second when a recording sheet S reaches the fixing apparatus 9 (fixing nip N) before the timing at which a recording sheet S on which this image was formed reaches the fixing apparatus 9. If the image formation of n-th sheet is completed (S209), time T at this time is stored in R (S210).

A reservation for decelerating the fixing roller 51 to ⅓ of the normal speed is made when B is smaller than U3+U4 and greater than U1+U2 (when the fixing roller 51 is decelerated and again accelerated within time between sheets) (S207), and when a recording sheet S on which an image was formed before 1 passed through the fixing apparatus 9. A reservation for returning the fixing roller 51 to the constant speed of the normal speed before U2 second when a recording sheet S on which this image was formed reaches the fixing apparatus 9 before this recording sheet S reaches the fixing apparatus 9 (S208).

Similarly to the above, if the image formation of the n-th sheet is completed (S209), time T at this time is stored in R (S210).

When the above series of operations is completed and the print job is continued (S211), n is counted up and the same trial is repeated (S212).

When a recording sheet S passes through the fixing apparatus 9 and a next image is not formed (S213), the pressure belt 53 is brought into a detached state (S214).

As described above, in this embodiment, information corresponding to a distance between a leading recording sheet S and a subsequent recording sheet S is calculated from the image writing timing, and time between sheets corresponding to the distance between the sheets is compared with time required for changing the modes. If it is time during which the separating operation or crimping operation of the pressure belt can be carried out, the separating operation is preferentially carried out. Even if this timing is too fast for the separating operation and the crimping operation, if the deceleration mode can be carried out, the deceleration mode is executed, the fixing roller 51 is decelerated and rotated to suppress the temperature rise of the pressure belt 53.

If there is no room (time) to execute the deceleration mode, the constant mode is selected, the fixing roller 51 and the pressure belt 53 crimp each other and in this state, the rotation thereof is maintained at the same peripheral speed as that of the fixing operation. Even if the constant mode was selected, since no recording sheet S existed in the fixing nip N and there was no time for heating the pressure belt 53 by the fixing roller 51, the temperature of the pressure belt did not exceeds the set temperature.

Third Embodiment

Next, an apparatus according to a third embodiment will be described. Since the basic structure of the apparatus in the embodiment is the same as that of the previous embodiment, explanation thereof will be omitted, and a structure of a feature of the embodiment will be described. Members having the same functions as those of the previous embodiment are designated with the same symbols.

In this embodiment, the shortest time during which a recording sheet S reaches the fixing roller 51 is calculated from pickup timing of the recording sheet S from a supply deck, thereby selecting and determining the operation of the separation mode, the deceleration mode and the constant mode. A plurality of sheet cassettes 10 are disposed in the supply deck of the embodiment.

The pickup timing intervals of the recording sheets S are not always equal. For example, paper sheets in the sheet cassette 10 run out and the sheet cassette 10 is automatically changed to another sheet cassette 10 (automatic cassette change), and conveying timing of recording sheets S is delayed in some cases due to delay of sheet supply (pickup mistake).

In the automatic cassette change, if the number of recording sheets S remaining in the sheet cassette 10 becomes zero or a small number, the control unit 100 checks whether the same kind (same size) of recording sheets S are accommodated in the other sheet cassette 10. If the control unit 100 confirms that the same kind of recording sheets S are accommodated in the other sheet cassette 10, the sheet cassette 10 to be used is switched, and the image forming operation is continued without suspending the image forming operation so that recording sheets S are supplied from the other sheet cassette 10. When recording sheets S accommodated in the other sheet cassette 10 are not of the same kind, the control unit suspends the image forming operation, and displays "error" on an operation portion. This error display is to inform a user that there is no recording sheet in the sheet cassette 10, and to instruct a user to supply recording sheets S.

This embodiment has two sheet cassettes 10.

[Cooling Mode]

In the cooling mode of the embodiment, the arrival time Tc of a recording sheet S to the fixing apparatus 9 is determined from timing at which the recording sheet S is picked up from the supply deck cassette, and if the time is equal to or longer than the separation mode possible time Ta, the separation mode is executed to separate the pressure belt 53 from the fixing roller 51. When the arrival time is shorter than the separation mode possible time and longer than the deceleration mode possible time Tb, the deceleration mode is executed to reduce the rotation speed of the fixing roller 51, thereby reducing the temperature rise of the pressure belt 53 to the minimum level.

With this, the generation of slip of the pressure belt 53 is suppressed, the productivity at the time of continuous sheet operation is secured, and deterioration of usability caused by hot offset and downtime caused by abnormal temperature rise of the pressure belt 53 is prevented.

In the image forming apparatus of the embodiment, time during which a recording sheet S on which toner is transferred is conveyed from the timing at which the recording sheet is picked up and the recording sheet finally reaches the fixing apparatus 9 is about three seconds, and this value is always close to a constant value. Hence, it is possible to calculate the fixing apparatus arrival time of a recording sheet S from the image writing timing.

In this embodiment, the cooling mode is determined from the timing at which the pickup of a recording sheet S is completed as a reference.

The actual operation proceeds with the flow of the flowchart in FIG. 17 like the second embodiment. A temperature rise preventing mode procedure will be described concretely with reference to the flowchart.

Symbols U1, U2, U3 and U4 in the flowchart represent maximum necessary time required for changing the modes as shown in FIG. 18. In this embodiment, U1=0.3 seconds, U2=0.2 seconds, U3=1 second and U4=1 second. Further, n represents the number of sheets on which an image in a job should be written, T represents time elapsed after a job is started, R represents time at which image formation is completed, P represent time at which image formation is started, and B represents time between sheets obtained from P-R.

If the print job is received, an image writing executing number of sheets variable n is initialized to 1, an elapsed time variable T is initialized to 0, and T is increased with the elapsed time. A value of initial R is set to a value which is equal to or lower than −(U3+U4) because there is no image which is written before the first image (S201).

Next, when the image formation is started and at the timing in which an electrostatic image of an image signal is formed on the photosensitive drum 3 (S202), time T is stored in P (S203) and a distance B between sheets is calculated (S204).

A reservation for separating (detaching) the pressure belt 53 is made if the sheet passed through (fixing nip N) within time of the distance between sheet when the value B is greater than time U3+U4 required for separating/crimping operation (attaching/detaching) of the pressure belt 53. A reservation for starting the crimping operation (arrival) of the pressure belt 53 is made (S206) before U4 second when a recording sheet S reaches the fixing apparatus 9 before the timing at which a recording sheet S on which this image was formed reaches the fixing apparatus 9. If the image formation of n-th sheet is completed (S209), time T at this time is stored in R (S210).

A reservation for decelerating the fixing roller 51 to ⅓ of the normal speed is made when B is smaller than U3+U4 and greater than U1+U2 (when the fixing roller 51 is decelerated and again accelerated within time between sheets) (S207), and when a recording sheet S on which an image was formed before 1 passed through the fixing apparatus 9. A reservation for returning the fixing roller 51 to the constant speed of the normal speed before U2 second when a recording sheet S on which this image was formed reaches the fixing apparatus 9 before this recording sheet S reaches the fixing apparatus 9 (S208).

Similarly to the above, if the image formation of the n-th sheet is completed (S209), time T at this time is stored in R (S210).

When the above series of operations is completed and the print job is continued (S211), n is counted up and the same trial is repeated (S212).

When a recording sheet S passes through the fixing apparatus 9 and a next image is not formed (S213), the pressure belt 53 is brought into a detached state (S214).

As described above, in this embodiment, a distance between recording sheets S is calculated from the pickup timing of the recording sheet from the sheet cassette 10, and the time between sheets corresponding to the distance between sheets is compared with time required for changing modes. If it is time during which the separating operation or crimping operation of the pressure belt can be carried out, the separating operation is preferentially carried out. Even if this timing is too fast for the separating operation and the crimping operation, if the deceleration mode can be carried out, the deceleration mode is executed, the fixing roller 51 is decelerated and rotated to suppress the temperature rise of the pressure belt 53.

Other Embodiment

In the embodiment above, the sheet arrival timing to the fixing apparatus 9 is calculated from the starting timing of image formation which is a sheet detection signal from the sheet sensor or a signal from the controller and from conveying timing of a recording sheet S from the conveying unit, thereby determining operations of the separation mode and deceleration mode.

However, if it is possible to precisely measure the sheet arrival timing to the fixing apparatus 9, other timing may be acceptable. For example, an operation timing signal of a secondary transfer registration sensor portion and a sheet position detection sensor provided in a sheet conveying path may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-262839, filed Oct. 9, 2007, which is hereby incorporated by reference herein in its entirety.

What is claimed is:

1. An image forming apparatus comprising:

an image forming unit for forming a toner image on a recording material;

a pair of fixing rotating members for forming a fixing nip to fix a toner image on the recording material to the recording material;

speed changing means for changing rotation speeds of the pair of fixing rotating members; and means for selecting and executing a plurality of modes during a continuous image forming process on a plurality of recording media, the modes comprising a deceleration mode for reducing, with the speed changing means, the rotation speed of the pair of fixing rotating members, while keeping the pair of fixing rotating members in contact with each other in an interval during which no recording medium passes through the fixing nip, and a separation mode for separating the pair of fixing rotating members for a longer time than the duration of the deceleration mode.

2. An image forming apparatus according to claim 1, wherein the means for selecting and executing a) selects the deceleration mode when the interval between a previously conveyed recording medium and the next conveying recording medium to reach the fixing nip is shorter than a predetermined time, and b) selects the separation mode when the interval between previously conveyed recording medium and the next conveying recording medium to reach the fixing nip is equal to or longer than the predetermined time.

3. An image forming apparatus according to claim 2, further comprising detecting means for detecting the interval when the next recording medium reaches the fixing nip.

4. An image forming apparatus according to claim 2, wherein the interval between previously conveyed recording medium and the next conveying recording medium is measured from an image-formation start time for starting image formation on the recording medium.

5. An image forming apparatus according to claim 1, wherein when changing to another mode from the deceleration mode, the speed changing means changes the rotation speed of the pair of fixing rotation members to a speed of the pair of fixing rotation members before the deceleration mode and passes the next recording medium.

6. An image forming apparatus according to claim 1, wherein the plurality of modes of the means for selecting and executing also includes a constant mode to set a speed of the pair of fixing rotation member as the same as the speed of a fixing process.

7. An image forming apparatus according to claim 1, further comprising a fan for cooling at least one of fixing rotation members and fan cooling means, wherein the fan cooling means separates the pair of fixing rotation members and makes the fan cool one of the separated fixing rotation members.

8. An image forming apparatus according to claim 1, wherein a rotation speed of the pair of rotation members in the deceleration mode is more than 1/10 and less than ⅔ of the speed thereof during a fixing process.

* * * * *